United States Patent [19]

Shimazaki et al.

[11] Patent Number: 4,725,529

[45] Date of Patent: Feb. 16, 1988

[54] DEVELOPING INHIBITOR ARRANGMENT IN LIGHT-SENSITIVE SILVER HALIDE COLOR PHOTOGRAPHIC MATERIALS

[75] Inventors: Hiroshi Shimazaki; Eiichi Sakamoto; Satoshi Nakagawa; Hiroshi Inoie; Minoru Ishikawa, all of Hino, Japan

[73] Assignee: Konishiroku Photo Industry Co., Ltd., Tokyo, Japan

[21] Appl. No.: 854,141

[22] Filed: Apr. 21, 1986

[30] Foreign Application Priority Data

Apr. 30, 1985 [JP] Japan ..... 60-93411

[51] Int. Cl.[4] ..... G03C 1/46

[52] U.S. Cl. ..... 430/505; 430/506; 430/507; 430/957

[58] Field of Search ..... 430/505, 957, 506, 507

[56] References Cited

U.S. PATENT DOCUMENTS

| | | | |
|---|---|---|---|
| 3,632,345 | 1/1972 | Marx et al. | 430/543 |
| 4,267,264 | 5/1981 | Lohmann et al. | 430/506 X |
| 4,477,560 | 10/1984 | Koitabashi et al. | 430/558 X |

FOREIGN PATENT DOCUMENTS

| | | |
|---|---|---|
| 0115304 | 8/1984 | European Pat. Off. . |
| 2010818 | 7/1979 | United Kingdom . |

*Primary Examiner*—Paul R. Michl
*Assistant Examiner*—Mukund J. Shah
*Attorney, Agent, or Firm*—Frishauf, Holtz, Goodman & Woodward

[57] ABSTRACT

There is disclosed a light-sensitive silver halide photographic material, having two or more light-sensitive silver halide emulsion layers different in color sensitivities on a support, at least two of the light-sensitive silver halide emulsion layers different in color sensitivities containing a DIR compound capable of releasing a developing inhibitor or developing inhibitor precursor through the reaction with the oxidized product of a developing agent, the developing inhibitor or developing inhibitor precursor released from the DIR compound being diffusive, wherein the following conditions A:

DIR compounds are added and incorporated in the emulsion layers so that the developing inhibitor released from the DIR compound incorporated in one color-sensitive silver halide emulsion layer and the developing inhibitor released from the DIR compound incorporated in the other color-sensitive silver halide emulsion layer are reversed in developing inhibiting power when the DIR compounds to be incorporated in the respective light-sensitive silver halide emulsion layers are exchanged with each other, and also each DIR compound may have greater inhibiting power for the other light-sensitive silver halide emulsion layer rather than for the light-sensitive silver halide emulsion layer in which it is incorporated, is satisfied for the at least two light-sensitive silver halide emulsion layers different in color sensitivities.

10 Claims, No Drawings

DEVELOPING INHIBITOR ARRANGMENT IN LIGHT-SENSITIVE SILVER HALIDE COLOR PHOTOGRAPHIC MATERIALS

BACKGROUND OF THE INVENTION

This invention relates to a light-sensitive silver halide color photographic material more emphasized in the interimage effect (hereinafter called I.I.E.) and a light-sensitive silver halide color photographic material improved in color reproducibility and sharpness thereby.

Generally speaking, a light-sensitive silver halide color photographic material has three kinds of silver halide emulsion layers for photography spectrally sensitized selectively so as to have sensitivity to blue light, green light and red light provided by coating on a support. For example, in the light-sensitive silver halide photographic material for color negative film, there are generally provided a blue-sensitive silver halide emulsion layer, a green-sensitive silver halide emulsion layer and a red-sensitive silver halide emulsion layer, in order, from the side exposed In addition, a yellow filter layer capable of bleaching is provided between the blue-sensitive silver halide emulsion layer and the green-sensitive silver halide emulsion layer for absorption of the blue light passed through the blue-sensitive silver halide emulsion layer. Further, it is usual to provide other intermediate layers for various special purposes between the respective emulsion layers and a final protective layer, as the outermost layer. It is also known to provide the respective light-sensitive silver halide emulsion layers in arrangements different from that as described above. Other arrangements include the use of a light-sensitive silver halide emulsion layer consisting of two or more layers having light sensitivity to substantially the same wavelength region to respective color lights but differing in sensitivity. In these light-sensitive silver halide color photographic materials, the exposed silver halide grains are developed with, for example, an aromatic primary amine type color developing agent, and the dye image is formed through the reaction between the oxidized product of the color developing agent formed and a dye forming coupler. In this method, for formation of dye images of cyan, magenta and yellow, phenol or naphthol type cyan couplers, 5-pyrazolone type, pyrazolinobenzimidazole type, pyrazolotriazole type, indazolone type or cyanoacetyl type magenta couplers and acylacetamide type yellow couplers are used, respectively. These dye forming couplers are contained in the light-sensitive silver halide emulsion layer or the developing solution. The present invention is suitable as a light-sensitive silver halide color photographic material containing the coupler previously made non-diffusible in the silver halide emulsion layer.

In recent years, marked improvement can be seen in image quality of light-sensitive silver halide color photographic materials, but color reproducibility is not yet satisfactory. Particularly, there are involved a number of insufficient points in reproduction of saturation of color (chroma). Conceivable causes therefore may be the spectral characteristics of the color formed dye obtained from the coupler (absence of sufficient absorption in the specific wavelength region or presence of unnecessary absorption in another wavelength region), color mixing due to migration of spectral sensitizing dye, or otherwise color mixing of the color developing agent with the oxidized product.

One of the characteristics demanded for the light-sensitive color photographic material is absence of turbidity in color, namely high color purity, during formation of a dye image in one color-sensitive layer by color formation of other color-sensitive layers by the oxidized product of the color developing agent formed therein.

In the prior art, it has been known to provide an interception layer (IL) which is also called the intermediate layer between different color-sensitive layers and add a scavenger of the oxidized product of the color developing agent or a non-color-indicating coupler in said interception layer (IL), or add a diffusion preventive for the senstizing dye, etc. such as fine particulate silver halide grains, a cationic hydrophilic synthetic polymer, a polymer latex, etc. in the interception layer (IL). However, even by these methods, no fully satisfactory color reproducibility has been achieved.

As another method for improvement of color mixing, a technique of automatic masking by use of a colored coupler is known and used routinely in negative light-sensitive silver halide color photographic materials, but the level of color reproducibility is far from satisfactory.

The techniques for improving color reproducibility by emphasizing I.I.E. with the use of DIR couplers have been known, and various compounds are used as these DIR compounds. For example, there may be included the so-called DIR couplers which form color forming dyes through the oxidized product of a color developing agent simultaneously with release of a developing inhibitor during development, the so-called DIR substances which release a developing inhibitor through the reaction with the oxidized product of a color developing agent but do not form a color forming dye, those which can release directly or indirectly a developing inhibitor through the reaction with the oxidized product of a color developing agent as disclosed in Japanese Provisional Patent Publications No. 145135/1979, No. 154234/1982, No. 162949/1983, No. 205150/1983, No. 195643/1984, No. 206834/1984, No. 206836/1984, No. 210440/1984 and No. 7429/1985 (hereinafter called timing DIR compounds). In the present specification, those exhibiting the above DIR effect are called comprehensively as the DIR compounds.

When these DIR compounds are used in light-sensitive silver halide color materials, developing inhibitors can be released from DIR compounds during development to obtain the effect of inhibiting development in other silver halide emulsion layers, namely I.I.E. Particularly, DIR compounds capable of releasing the so-called diffusive inhibiting groups or diffusive developing inhibitor precursors are effective. They have been used for silver halide color films in these days to give some effects. However, due to strong directional tendency of I.E.E. (for example, strong in the direction from a blue-sensitive silver halide emulsion layer to a green-sensitive silver halide emulsion layer, but weak in the opposite direction), although improvement of saturation (chroma) of a specific color may be expected, an undesirable effect of "dislocation in hue" is accompanied therewith. Also, with respect to diffusiveness, since the inhibiting effect acts most strongly on the added layer, and therefore problems are involved such as lowering in gamma ($\gamma$), lowering in sensitivity, lowering in color formed density, etc. Thus, it is difficult to use an amount which can give sufficient effects to other layers.

The techniques for emphasizing I.I.E. from a color-sensitive layer to a different color-sensitive layer with the use of the so-called diffusive DIR compound are disclosed in Japanese Patent Publication No. 47379/1980, Japanese Provisional Patent Publications No. 93344/1982, No. 56837/1982 and No. 131937/1984. Even by use of these techniques, only unsatisfactory improvement of color reproducibility can be expected under the present situation.

Accordingly, a first object of the present invention is to improve color reproducibility, particularly reproduction of saturation (chroma), by making greater I.I.E. in both directions between different color-sensitive layers.

On the other hand, it has been known to improve sharpness of an image, when I.I.E. is created by use of the so-called diffusive DIR compound as disclosed in the above patent publications or specifications.

This is due to improvment of color contrast accompanied with I.I.E, which is the edge effect between layers in addition to the edge effect in the added layer.

Accordingly, a second object of the present invention is to improve sharpness of an image by emphasizing I.I.E. in both directions by use of a DIR compound according to a suitable method.

SUMMARY OF THE INVENTION

The light-sensitive silver halide color photographic material of the present invention which solves the above objects has two or more light-sensitive silver halide emulsion layers different in color sensitivities on a support, at least two of said light-sensitive silver halide emulsion layers different in color sensitivities containing a compound capable of releasing a developing inhibitor or developing inhibitor precursor through the reaction with the oxidized product of a developing agent (DIR compound), the developing inhibitor or developing inhibitor precursor released from said DIR compound being diffusive, wherein the following conditions A is satisfied for said at least two light-sensitive silver halide emulsion layers different in color sensitivities:

[condition A]

DIR compounds are added and incorporated in the emulsion layers so that the developing inhibitor released from the DIR compound incorporated in one color-sensitive silver halide emulsion layer and the developing inhibitor released from the DIR compound incorporated in the other color-sensitive silver halide emulsion layer are reversed in developing inhibiting power when said DIR compounds to be incorporated in the respective light-sensitive silver halide emulsion layers are exchanged with each other, and also each DIR compound may have greater inhibiting power for the other light-sensitive silver halide emulsion layer rather than for the light-sensitive silver halide emulsion layer in which it is incorporated.

DESCRIPTION OF THE PREFERRED EMBODIMENTS

Ordinarily, when a DIR compound is used in a color-sensitive layer, even if the developing inhibitor or its precursor (hereinafter referred to as developing inhibitor inclusive of this precursor) may be diffusive, the added layer itself which is the releasing layer is most inhibited, and it is difficult to use a large amount of a DIR compound due to lowering in density and lowering in sensitivity.

When a DIR compound is used in a certain layer, the layer is subject to developing inhibiting power of a certain greatness by the developing inhibitor of the DIR compound in its own layer. For this reason, there occurs the phenomenon that the developing inhibiting effect by the developing inhibitor supplied from other layers cannot fully be exhibited. In other words, when I.I.E. in both directions is desired to be formed between the two color-sensitive layers, both I.I.E become lower levels or only one direction becomes strong, while the other direction markedly weak.

However, it has been clarified as the result of the study by the present inventors that the developing inhibitor releases exhibit different developing inhibiting powers in different color-sensitive layers and also that there is difference in the manner in which the developing inhibiting powers differ depending on the kind of said developing inhibitor.

For example, when a developing inhibitor A and a developing inhibitor B are used in equal moles in a green-sensitive silver halide emulsion layer and a red-sensitive silver halide emulsion layer, respectively, in the case of $A>B$ with respect to the developing inhibiting power for the green-sensitive silver halide emulsion layer and $A<B$ with respect to the developing inhibiting power for the red-sensitive silver halide emulsion layer, by addition of a DIR compound having the developing inhibitor B in the green-sensitive silver halide emulsion layer and a DIR compound having the developing inhibitor A in the red-sensitive silver halide emulsion layer, it becomes possible to make the self-layer inhibitions in respective layers weaker, while giving greater influences [greater I.I.E] to other color-sensitive layers to enable epoch-making improvement of I.I.E in both directions.

Also, for example, when a developing inhibitor E and a developing inhibitor F are used in equal moles in a blue-sensitive silver halide emulsion layer and a red-sensitive silver halide emulsion layer, respectively, in the case of $E<F$ with respect to the developing inhibiting power for the blue-sensitive silver halide emulsion layer and $E>F$ with respect to the developing inhibiting power for the red-sensitive silver halide emulsion layer, by addition of a DIR compound having the developing inhibitor E in the blue-sensitive silver halide emulsion layer and a DIR compound having the developing inhibitor F in the red-sensitive silver halide emulsion layer, it becomes possible to make the self-layer inhibitions in respective layers weaker, while giving greater influences [greater I.I.E] to other color-sensitive layers to enable epoch-making improvement of I.I.E in both directions.

The present invention is not limited to the case of employing the developing inhibitors in equal moles, but it is possible to increase the I.I.E. both directions when the above relationship can be exhibited by increasing or decreasing the amounts of the respective developing inhibitors. For example, by use of a developing inhibitor G and a developing inhibitor H, in the case of $G>>H$ with respect to developing inhibiting power for a green-sensitive silver halide emulsion layer and $G>H$ with respect to developing inhibiting power for a red-sensitive silver halide emulsion layer in respective equal moles, when reduction in amount of the developing inhibitor G added (hereinafter expressed as the developing inhibitor G') makes the relationships of $G'>H$ in the green-sensitive silver halide emulsion layer and G'<H in the red-sensitive silver halide emulsion layer valid, by addition of a DIR compound having the developing inhibitor H in the green-sensitive silver halide emulsion layer and a DIR compound having the developing inhibitor G in the red-sensitive silver halide emulsion layer at a lower (molar) level than in the former, great I.I.E. in both directions could be obtained. The same results were obtained between the color-sensitive layers of other different kinds.

And, when the combinations of the DIR compounds having respective inhibiting groups and the layers in which they are added are reversed (for example, in the above example, a DIR compound having the developing inhibitor A is added in the green-sensitive silver halide emulsion layer and a DIR compound having the developing inhibitor B in the red-sensitive silver halide emulsion layer), the self-layer inhibiting became very strong to make I.I.E. in both directions markedly small. These matters are clarified also in the Examples shown hereinafter.

In the present invention, the manner of use of the DIR compound, namely selection of the inhibiting group of said DIR compound may be done, for example, according to the method as described below.

On a transparent support, three kinds of light-sensitive materials having the layers with the following compositions are prepared.

Sample (I): A sample having a red-sensitive silver halide emulsion layer

A gelatin coating solution containing a low-sensitivity red-sensitive silver halide emulsion described in Examples 1 and 2 hereinafter and 0.08 mole of the exemplary coupler (C-7) per mole of silver is applied to a coated silver amount of 1.4 g/m$^2$.

Sample (II): A sample having a green-sensitive silver halide emulsion layer

A gelatin coating solution containing a low-sensitivity green-sensitive silver halide emulsion described in Examples 1 and 2 hereinafter and 0.07 mole of the exemplary coupler (M-2) per mole of silver is applied to a coated silver amount of 1.1 g/m$^2$.

Sample (III): A sample having a blue-sensitive silver halide emulsion layer

A gelatin coating solution containing a low-sensitivity blue-sensitive silver halide emulsion described in Examples 1 and 2 hereinafter and 0.34 mole of the exemplary coupler (Y-4) per mole of silver is applied to a coated silver amount of 0.5 g/m$^2$.

In the respective layers, there are contained gelatin hardeners and surfactants in addition to the above components.

The above Samples (I) to (III) are prepared in accordance with the light-sensitive material used in Examples mentioned hereinafter.

The obtained samples (I) to (III) are subjected to white light exposure by use of a wedge and processed in the same manner as the processing method in Example 1 shown below except for making the developing time 1 min. 45 sec. for (I), 2 min. 40 sec. for (II) and 3 min. 15 sec. for (III). The developing time is a time for being closely resembled the developability of each color-sensitive layer of a multi-layered sample in a single-layered sample. In the developing solutions employed, various kinds of developing inhibitors in various amounts are added so that the developing inhibiting power in the sample (II) may be equal, or no inhibitor is added. The difference ($\Delta S$) between the sensitivity *1 ($S_0$) of the respective samples (I) to (III) processed with the developer containing no developing inhibitor and the sensitivity *2 (S) of the respective samples obtained by development of a developing solution containing the developing inhibitors is used as a measure of the developing inhibiting power in the respective color-sensitive layers by the respective developing inhibitors. point with fog density +0.3, namely—log E is defined as sensitivity S.

The differences in developing inhibiting power of several kinds of developing inhibitors for respective color-sensitive layers conducted on the basis of the above standard experiments are shown in Table 1.

TABLE 1

| Compound No. | Structure | Amount added (mole/l) | Inhibiting power S ($\Delta$log E) Sample (I) | Sample (II) | Sample (III) |
|---|---|---|---|---|---|
| A-1 | 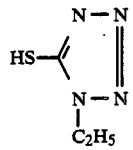 | $1.5 \times 10^{-4}$ | 0.43 | 0.53 | 0.34 |
| A-2 | 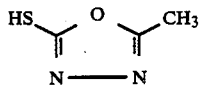 | $1.5 \times 10^{-4}$ | 0.48 | 0.53 | 0.24 |
| A-3 | 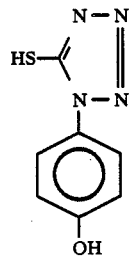 | $1.0 \times 10^{-4}$ | 0.72 | 0.51 | 0.48 |

TABLE 1-continued

| Compound No. | Structure | Amount added (mole/l) | Inhibiting power S (Δlog E) Sample (I) | Sample (II) | Sample (III) |
|---|---|---|---|---|---|
| A-4 | 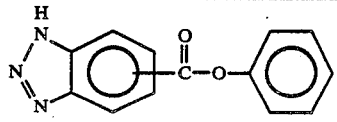 | $1.0 \times 10^{-4}$ | 0.64 | 0.50 | 0.38 |
| A-5 | 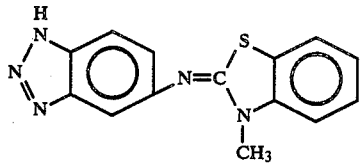 | $0.2 \times 10^{-4}$ | 0.60 | 0.49 | 0.45 |
| A-6 | 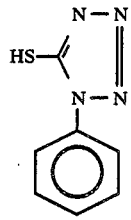 | $0.2 \times 10^{-4}$ | 0.58 | 0.51 | 0.45 |

When employing the DIR couplers having the above developing inhibitors A-1 to A-6, they can be used in a combination such that developing inhibition is small in the layer itself added and developing inhibition is great in another layer.

Since order of developing inhibiting powers of each developing inhibitor as exemplified in Table 1 to the respective color-sensitive layers in this system is not changed by the amount added, for making a preferable combination between a red-sensitive silver halide emulsion layer and a blue-sensitive silver halide emulsion layer, for example, the values in the red-sensitive silver halide emulsion layer (Sample (I)) are normalized to the values for one compound, and the values of the blue-sensitive silver halide emulsion layer (Sample (III)) divided by the ratio obtained by normalization can be determined (see Table 2).

TABLE 2

| | Sample (I) | | Sample (III) | |
|---|---|---|---|---|
| | | Normalization | | Inhibiting power ratio |
| A - 1 | 0.43 | 0.43 | 0.34 | 0.34 |
| A - 2 | 0.48 | 0.43 | 0.24 | 0.22 |
| A - 3 | 0.72 | 0.43 | 0.48 | 0.29 |
| A - 4 | 0.64 | 0.43 | 0.38 | 0.26 |

That is, from Table 2, the following examples of combinations are included.

[Examples of combinations of the developing inhibitor of DIR compound added in red-sensitive silver halide emulsion layer/the developing inhibitor of DIR compound added in green-sensitive silver halide emulsion layer]

(1) A-1/A-2, (2) A-1/A-3, (3) A-1/A-4, (4) A-1/A-5, (5) A-1/A-6, (6) A-2/A-3, (7) A-2/A-4, (8) A-2/A-5, (9) A-2/A-6, (10) A-4/A-3, (11) A-5/A-3, (12) A-5/A-4, (13) A-6/A-3, (14) A-6/A-4, etc.

Similarly, also between the green-sensitive silver halide emulsion layer and the blue-sensitve silver halide emulsion layer, between the red-sensitive silver halide emulsion layer and the blue-sensitive silver halide emulsion layer, preferable combinations with smaller inhibition in the added layer and greater inhibition in another layer can be selected.

Also, for emphasizing I.I.E., the action distance of the inhibiting groups should preferably be great. That is, the so-called diffusiveness should be preferably great.

In the present invention, the diffusiveness of the inhibiting group can be evaluated according to the method described below.

On a transparent support, light-sensitive samples (IV) and (V) comprising the layers with the following compositions are prepared.

Sample (IV): A sample having a green-sensitive silver halide emulsion layer

A gelatin coating solution containing a silver iodobromide (silver iodide 6 mole %, average grain size 0.48 μm) spectrally sensitized to green-sensitive and 0.07 mole of the exemplary coupler (M-2) per mole of silver was applied to a coated silver amount of 1.1 g/m$^2$ and a gelatin attached amount of 3.0 g/m$^2$, followed by coating thereon of a protective layer: a gelatin coating solution containing silver iodobromide (silver iodide 2 mole %, average grain size 0.08 μm) not applied with chemical sensitization and spectral sensitization to a coated silver amount of 0.1 g/m$^2$ and a gelatin attached amount of 0.8 g/m$^2$.

Sample (V): The protective layer in the above sample (IV) from which silver iodobromide is removed.

In the respective layers, there are contained gelatin hardeners and surfactants in addition to the above components.

The samples (IV) and (V) are subjected to white light exposure and then processed according to the processing method as Example 1 except for changing the developing time to 2 min. 40 sec. In the developing solutions employed, various developing inhibitors are added in an amount of inhibiting the sensitivity of the sample (V) to 60% (in terms of logarithmic representation, $-\Delta$ log E=0.22), or no developing inhibitor is added at all.

When no developing inhibitor is added, the sensitivity of the sample (IV) is defined as $S_0$ and the sensitivity of the sample (V) as $S_0'$, while when developing inhibitor is added, the sensitivity of the sample (IV) is defined as $S_{IV}$ and the sensitivity of the sample (V) as $S_V$.

Sensitivity reduction of sample (IV):

$$\Delta S_0 = S_0' - S_V.$$

Sensitivity reduction of sample (V):

$$\Delta S = S_0 - S_{IV}.$$

$$\text{Diffusiveness} = \Delta S / \Delta S_0.$$

Sensitivities are all logarithmic values of the reciprocal of exposure dose (−log E) at the density point with fog density+0.3.

The value determined by this method is made a measure of diffusiveness. Diffusivenesses of several kinds of developing inhibitors are shown in Table 3.

TABLE 3

| Compound No. | Structure | Amount added (mole/l) | Sensitivity reduction $\Delta S_0$ | Sensitivity reduction $\Delta S$ | Diffusiveness $\Delta S/\Delta S_0$ |
|---|---|---|---|---|---|
| A-6 | 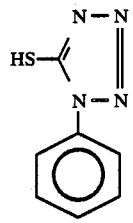 | $1.3 \times 10^{-5}$ | 0.22 | 0.05 | 0.23 |
| A-5 | 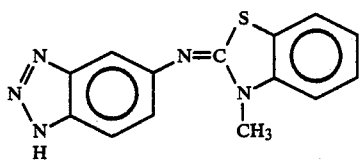 | $1.3 \times 10^{-5}$ | 0.23 | 0.08 | 0.34 |
| A-2 | 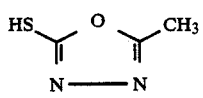 | $2.5 \times 10^{-5}$ | 0.22 | 0.10 | 0.45 |
| A-1 | 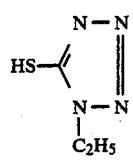 | $3.0 \times 10^{-5}$ | 0.21 | 0.10 | 0.48 |
| A-9 | 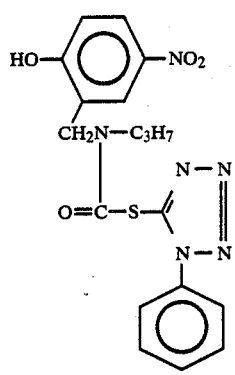 | $1.4 \times 10^{-5}$ | 0.23 | 0.11 | 0.48 |
| A-3 | 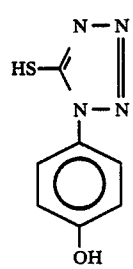 | $2.5 \times 10^{-5}$ | 0.22 | 0.13 | 0.59 |

TABLE 3-continued

| Compound No. | Structure | Amount added (mole/l) | Sensitivity reduction $\Delta S_0$ | Sensitivity reduction $\Delta S$ | Diffusiveness $\Delta S/\Delta S_0$ |
|---|---|---|---|---|---|
| A-4 | 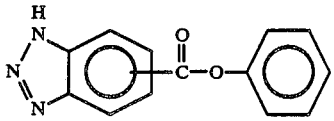 | $3.5 \times 10^{-5}$ | 0.23 | 0.15 | 0.65 |
| A-7 | 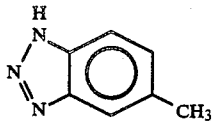 | $4.3 \times 10^{-5}$ | 0.22 | 0.16 | 0.73 |
| A-8 | 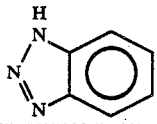 | $1.7 \times 10^{-5}$ | 0.21 | 0.20 | 0.95 |

As is also apparent from Example 1 shown below, a compound with relatively smaller diffusiveness (A-5: 0.34 or less) is also small in I.I.E., and therefore a compound with a diffusiveness exceeding 0.34 is preferred. In the present invention, compounds with diffusiveness of 0.4 or higher are further preferred.

In the light-sensitive silver halide color photographic material of the present invention, the respective emulsion layers with the same sensitivity (or at least one layer) can be divided into three layers or more, but it is preferred that the number of the layers should not exceed 3 layers for diffusiveness of the inhibitor or the inhibitor precursor formed from the DIR compound of the present invention.

In recent years, light-sensitive silver halide color photographic materials having sensitivity and good color reproducibility have been desired. The present invention is effectively applicable or even more effective for such a highly sensitive light-sensitive silver halide color photographic material.

As the layer constitution for higher sensitization, the following constitutions have been known. For example, in the above normal order layer constitution having respective silver halide emulsion layers of a red-sensitive silver halide emulsion layer, a green-sensitive silver halide emulsion layer and a blue-sensitive silver halide emulsion layer successively provided by coating on a support, there is a layer constitution in which, for a part or all of the light-sensitive silver halide emulsion layers, substantially the same color-sensitive layers are separated into a high sensitivity silver halide emulsion layer (hereinafter called high sensitivity emulsion layer) and a low sensitivity silver halide emulsion layer (hereinafter called low sensitivity emulsion layer) containing diffusion-resistant couplers color formed mutually to substantially the same hue, which are overlaid adjacent to each other. This layer constitution is hereinafter referred to as the high sensitivity normal order layer constitution.

On the other hand, as the reverse layer constitution accomplishing high sensitivity, the following techniques have been known.

[A] First, Japanese Provisional Patent Publication No. 49027/1976 discloses a constitution comprising:

(a) the respective low sensitivity emulsion layers of a red-sensitive silver halide emulsion layer and a green-sensitive silver halide emulsion layer (RG low sensitivity layer unit) provided by coating on a support in this order from the support side;

(b) the respective high sensitivity emulsion layers of a red-sensitive silver halide emulsion layer and a green-sensitive silver halide emulsion layer (RG high sensitivity layer unit) on said RG low sensitivity layer unit from the support side; and (c) high sensitivity and low sensitivity emulsion layers of a blue-sensitive silver halide emulsion layer (B high and low sensitivity layer unit) provided by coating on said RG high sensitivity layer unit as in the normal order layer constitution.

[B] Also, Japanese Provisional Patent Publication No. 97424/1978 discloses a constitution of the light-sensitive silver halide color photographic material with the above constitution [A], in which the red-sensitive silver halide emulsion layer and the green-sensitive silver halide emulsion layer in the RG low sensitivity layer unit are provided by coating as separated into medium sensitivity and low sensitivity layers.

[C] Further, Japanese Provisional Patent Publication No. 177551/1984 by the present Applicant discloses a constitution in which the RGB low sensitivity layer unit and the RGB high sensitivity layer unit are provided successively by coating on a support.

These light-sensitive silver halide color photographic materials with the constitutions [A], [B] and [C] (hereinafter referred to as high sensitivity reverse layer constitution) all have at least a high sensitivity red-sensitive silver halide emulsion layer with between a high sensitivity green-sensitive silver halide emulsion layer and a green-sensitive silver halide emulsion layer with lower sensitivity than said high sensitivity green-sensitive silver halide emulsion layer, and they are effective means for accomplishing the object of high sensitivity and high image quality.

The present invention is effectively applicable, or even more effective for any of the light-sensitive silver halide color photographic materials with the high sensitivity normal order layer constitution or the high sensitivity reverse order constitution as described above. Of the high sensitivity normal order layer constitution and the high sensitivity reverse order layer constitutions [A]–[C], the high sensitivity reverse order layer constitutions [A]-[C] are preferred, particularly the high sensitivity reverse order layer constitution [C] in which the adjacent light-sensitive layers are all different is preferred.

As described above, for application of the present invention for the case of a plural number of the same color-sensitive layers, the DIR compound to be combined in the present invention may be added into one of the layers, but it can more effectively be used in the plural number of layers of said same color-sensitive layer. When the same color-sensitive layer is plural in number, and the compound is added only in one layer, it should advantageously be added in the layer in which silver is most enriched.

The silver halide grains to be used in the present invention may be obtained according to any preparation method well known in the art such as the acidic method, the neutral method or the ammoniacal method.

For example, there may be employed the method in which seed grains are prepared by the acidic method, and further the seed grains are grown by the ammoniacal method with rapid growth speed to desired sizes. When the silver halide grains are grown, it is preferable to control pH, pAg, etc. in a reactor and inject successively at the same time silver ions and halide ions in amounts corresponding to the growth speed of the silver halide grains as described in, for example, Japanese Provisional Patent Publication No. 48521/1979.

Preparation of silver halide grains according to the present invention is conducted as described above. The composition containing said silver halide grains is referred to as silver halide emulsion in the present specification.

These silver halide emulsions may be chemically sensitized with a single sensitizer or a suitable combination of sensitizers (e.g. combination of a gold sensitizer and a sulfur sensitizer, combination of a gold sensitizer and a selenium sensitizer). Such sensitizers may include activated gelatin; sulfur sensitizers such as arylthiocarbamide, thiourea, cystine, etc.; selenium sensitizers; reducing sensitizers such as stannous salts, thiourea dioxide, polyamines, etc.; noble metal sensitizers such as gold sensitizers, specifically potassium aurithiocyanate, potassium chloroaurate, 2-aurothio-3-methylbenzothiazolium chloride, etc., or sensitizers of water soluble salts of, for example, ruthenium, palladium, platinum, rhodium, iridium, etc., specifically ammonium chloropalladate, potassium chloroplatinate and sodium chloropalladate (some of these may act as sensitizers or fogging inhibitors depending on the amount), etc.

The silver halide emulsion according to the present invention may be prepared by carrying out chemical ripening with addition of a sulfur-containing compound and incorporating at least one of hydroxytetrazaindene and at least one of nitrogen-containing heterocyclic compounds having mercapto group before, during or after the chemical ripening.

The silver halides to be used in the present invention may also be optically sensitized with addition of $5\times10^{-8}$ to $3\times10^{-3}$ mole of a suitable sensitizing dye in order to impart photosensitivity to the respective desired photosensitive wavelength regions. As the sensitizing dye, various dyes can be used and a combination with one dye or two or more dyes can also be used. The sensitizing dyes which can be advantageously used in the present invention are mentioned below.

That is, as the sensitizing dye to be used in the blue-sensitive silver halide emulsion, there may be included those as disclosed in West German Pat. No. 929,080; U. S. Pat. No. 2,231,658, No. 2,493,748, No. 2,503,776, No. 2,519,001, No. 2,912,329, No. 3,656,959, No. 3,672,897, No. 3,694,217, No. 4,025,349 and No. 4,046,572; U.K. Pat. No. 1,242,588; Japanese Patent Publications No. 14030/1969 and No. 24844/1977. As the sensitizing dye to be used in the green-sensitive silver halide emulsion, there may be included cyanine dyes, merocyanine dyes or complex cyanine dyes as disclosed in, for example, U.S. Pat. No. 1,939,201, No. 2,072,908, No. 2,739,149 and No. 2,945,763; and U.K. Pat. No. 505,979, as representative ones. Further, as the sensitizing dye to be used in the red-sensitive silver halide emulsion, there may be included cyanine dyes, merocyanine dyes or complex cyanine dyes as disclosed in, for example, U.S. Pat. No. 2,269,234, No. 2,270,378, No. 2,442,710, No. 2,454,629 and No. 2,776,280, as representative ones. Furthermore, cyanine dyes, merocyanine dyes or complex cyanine dyes as disclosed in U.S. Pat. No. 2,213,995, No. 2,493,748 and No. 2,519,001 and West German Pat. No. 929,080 can also advantageously be used in the green-sensitive silver halide emulsion or the red-sensitive silver halide emulsion.

These sensitizing dyes may be used either singly or as a combination of these.

The light-sensitive photographic material of the present invention may also be subjected to optical sensitization to a desired wavelength region according to the spectral sensitizing method by using cyanine or merocyanine dyes either singly or in combination.

Typical examples of the particularly preferred spectral sensitizing dye may include the methods concerning the combination of benzimidazolocarbocyanine and benzooxazolocarbocyanine as disclosed in Japanese Patent Publications No. 4936/1968, No. 22884/1968, No. 18433/1970, No. 37443/1972, No. 28293/1973, No. 6209/1974, No. 12375/1978; Japanese Provisional Patent Publications No. 23931/1977, No. 51932/1977, No. 80118/1979, No. 153926/1983, No. 116646/1984 and No. 116647/1984.

Concerning the combination of carbocyanine having benzimidazole nucleus and other cyanines or merocyanines, there may be included, for example, Japanese Patent Publications No. 25831/1970, No. 11114/1972, No. 25379/1972, No. 38406/1973, No. 38407/1973, No. 34535/1979 and No. 1569/1980; Japanese Provisional Patent Publications No. 33220/1975, No. 38526/1975, No. 107127/1976, No. 115820/1976, No. 135528/1976, No. 104916/1977 and No. 104917/1977.

Further, concerning benzoxazolocarbocyanine (oxacarbocyanine) and other carbocyanines, there may be included, for example, Japanese Patent Publications No. 32753/1969 and No. 11627/1971; Japanese Provisional Patent Publication No. 1483/1982; and, concerning the combination with meerocyanines, there may be included, for example, Japanese Patent Publications No. 38408/1973, No. 41204/1973 and No. 40662/1975; Japanese Provisional Patent Publications No. 25728/1981, No. 10753/1983, No. 91445/1983, No. 116645/1984 and No. 33828/1975.

Also, concerning the combination of thiacarbocyanine with other carbocyanines, there may be included, for example, Japanese Patent Publications No. 4932/1968, No. 4933/1968, No. 26470/1970, No. 18107/1971 and No. 8741/1972; Japanese Provisional Patent Publication No. 114533/1984. Further, it is possible to use advantageously the method as disclosed in Japanese Patent Publication No. 6207/1974 using zeromethyne or dimethynemelocyanine, monomethyne or trimethynecyanine and a styryl dye.

For addition of these sensitizing dyes into the silver halide emulsion according to the present invention, they can be used as the dye solutions by dissolving them previously in hydrophilic solvents such as methyl alcohol, ethyl alcohol, acetone and dimethylformamide, or fluorinated alcohols as disclosed in Japanese Patent Publication No. 40659/1975.

The timing of addition may be either at initiation of chemical ripening of the silver halide emulsion, during the chemical ripening or on completion of the chemical ripening. In some cases, they can be added also in the step immediately before coating of the emulsion.

In the light-sensitive silver halide color photographic material of the present invention, there may also be incorporated water-soluble dyes as filter dyes in hydrophilic colloid layers or for various other purposes such as irridation prevention, etc. Such dyes may include oxonol dyes, hemioxonol dyes, merocyanine dyes and azo dyes. Among them, oxonol dyes, hemioxonol dyes and merocyanine dyes are useful. Specific examples of available dyes are disclosed in U.K. Pat. No. 584,609 and No. 1,277,429; Japanese Provisional Patent Publications No. 85130/1973, No. 99620/1974, No. 114420/1974, No. 129537/1974, No. 108115/1977 and No. 25845/1984; U.S. Pat. No. 2,2,74,782, No. 2,533,472, No. 2,956,879, No. 3,125,448, No. 3,148,187, No. 3,177,078, No. 3,247,127, No. 3,540,887, No. 3,575,704, No. 3,653,905, No. 3,718,472, No. 4,071,312 and No. 4,070,352.

These water-soluble dyes can be more effectively fixed as mordant. The techniques for making these dyes mordant are described in U.S. Pat. No. 2,326,057, No. 2,882,156 and No. 3,740,228 and Japanese Patent Publications No. 15820/1974 and No. 33899/1984.

Next, the diffusive DIR compounds to be preferably used in the present invention are to be described.

The diffusive DIR compounds of the present invention are represented by the formula shown below.

Formula (A) of diffusive DIR compound:

$$A\text{-}(Y)_m$$

wherein A represents a coupler component, m represents 1 or 2 and Y is a group which is bonded to the coupler component A at its coupling position and eliminable through the reaction with the oxidized product of a color developing agent, representing a developing inhibitor with great diffusiveness or a compound capable of releasing a developing inhibitor.

The group A may have the properties of a coupler and is not necessarily required to form a dye through coupling.

In the formula (1) of the diffusive DIR compound, Y represents the formulae (2A) to (5) shown below.

Diffusive DIR compound formula (2A):

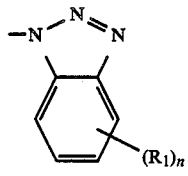

Diffusive DIR compound formula (2B):

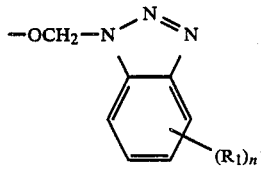

Diffusive DIR compound formula (2C):

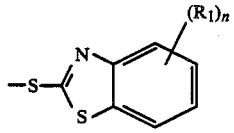

Diffusive DIR compound formula (2D):

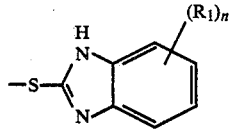

Diffusive DIR compound formula (2E):

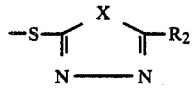

(X: O, S or Se)

Diffusive DIR compound formula (3):

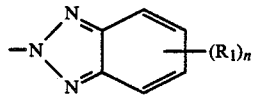

Diffusive DIR compound formula (4):

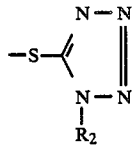

Diffusive DIR compound formula (5):

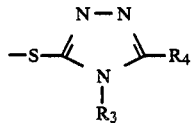

In the above formulae (2A) to (2D) and (3), $R_1$ represents an alkyl group, an alkoxy group, an acylamino group, a halogen atom, an alkoxycarbonyl group, a thiazolylideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a heterocyclic group, a cyano group, an alkylsulfonyl group or an aryloxycarbonylamino group. n represents 1 or 2 and, when n is 2, $R_1$ may be the same or different, and the total number of carbon atoms contained in $R_1$ in number of n may be 0 to 10.

$R_2$ is the above formula (2E) has the same meaning as $R_1$ in (2A) to (2D), X represents an oxygen atom or a sulfur atom and $R_2$ in the formula (4) represents an alkyl group, an aryl group or a heterocyclic group.

In the formula (5), $R_3$ represents a hydrogen atom, an alkyl group, an aryl group or a heterocyclic group; $R_4$ represents a hydrogen atoms, an alkyl group, an aryl group, a halogen atom, an acylamino group, an alkoxycarbonylamino group, an aryloxycarbonylamino group, an alkanesulfonamide group, a cyano group, a heterocyclic group, an alkylthio group or an amino group.

When $R_1$, $R_2$, $R_3$ or $R_4$ represents an alkyl group, it may be either substituted or unsubstituted, straight or branched, or it may also be a cyclic alkyl. The substituents may include a halogen atom, a nitro group, a cyano group, an aryl group, an alkoxy group, an aryloxy group, an alkoxxycarbonyl group, an aryloxycarbonyl group, a sulfamoyl group, a carbamoyl group, a hydroxy group, an alkanesulfonyl group, an arylsulfonyl group, an alkylthio group or an arylthio group.

When $R_1$, $R_2$, $R_3$ or $R_4$ represents an aryl group, the aryl group may be substituted. The substitutents may include an alkyl group, an alkenyl group, an alkoxy group, an alkoxycarbonyl group, a halogen atom, a nitro group, an amino group, a sulfamoyl group, a hydroxy group, a carbamoyl group, an aryloxycarbonylamino group, an alkoxycarbonylamino group, an acylamino group, a cyano group or a ureido group.

When $R_1$, $R_2$, $R_3$ or $R_4$ represents a heterocyclic group, it represets a 5- or 6-membered monocyclic or fused ring containing nitrogen atom, oxygen atom or sulfur atom as the hetero atom, selected from a pyridyl group, a quinolyl group, a furyl group, a benzothiazolyl group, an oxazolyl group, an imidazolyl group, a thiazolyl group, a triazolyl group, a benzotriazolyl group, an imide group, an oxazine group and the like, and these may be further substituted with substituents as enumerated above for the aryl group.

In the formulae (2E) and (4), $R_2$ may have 1 to 15 carbon atoms.

In the above formula (5), the total number of carbon atoms contained in $R_3$ and $R_4$ is 1 to 15. In the above formula (1), Y represents the following formula (6) shown below.

Diffusive DIR compound formula (6)

—TIME—INHIBIT wherein TIME group is a group which is bonded to the coupler at its coupling position, can be cleaved through the reaction with a color developing inhibition, and can release the INHIBIT group after cleavage from the coupler with moderate control; and INHIBIT group is a developing inhibitor.

In the formula (6), —TIME—INHBIT group represents the formulae (7) to (13) shown below:

Diffusive DIR compound formula (7):

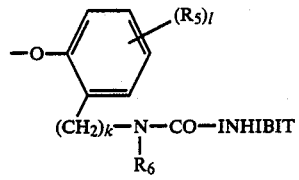

Diffusive DIR compound formula (8):

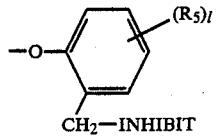

Diffusive DIR compound formula (9):

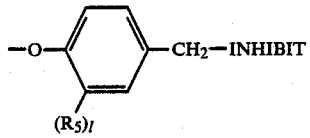

Diffusive DIR compound formula (10):

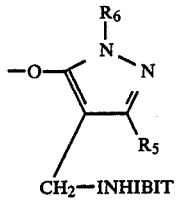

Diffusive DIR compound formula (11):

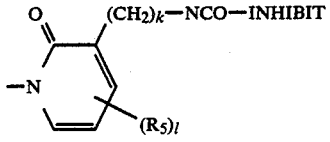

Diffusive DIR compound formula (12):

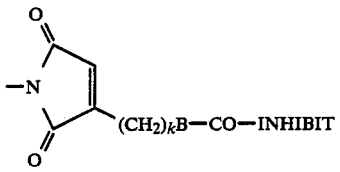

Diffusive DIR compound formula (13):

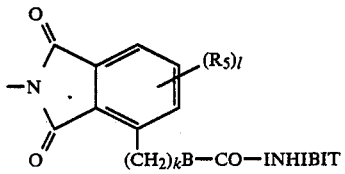

In the formulae (7) to (13), $R_5$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamide group, a sulfamoyl group, a carbamoyl group, an aryl group, a carboxy group, a sulfo group, a hydroxy group or an alkanesulfonyl group.

In the formulae (7), (8), (9), (11) and (13), l represents 1 or 2.

In the formulae (7), (11), (12) and (13), k represents an integer of from 0 to 2.

In the formulae (7), (10) and (11), $R_6$ represents an alkyl group, an alkenyl group, an aralkyl group, a cycloalkyl group or an aryl group.

In the formulae (12) and (13), B represents an oxygen atom or

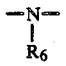

($R_6$ has the same meaning as defined above).

INHIBIT group represents the same meaning as defined for the formulae (2A), (2B), (3), (4) and (5) except for the carbon number.

However, in the formulae (2A), (2B) and (3), the total number of carbon atoms contained in each $R_1$ in one molecule is 1 to 32, while the number of carbon atoms contained in $R_2$ in the formula (4) is 1 to 32 and the total number of carbon atoms contained in $R_3$ and $R_4$ in the formula (5) is 0 to 32.

When $R_5$ and $R_6$ represent alkyl groups, they may be either substituted or unsubstituted, straight or cyclic. Substituents may include those as enumerated for the alkyl groups of $R_1$ to $R_4$.

When $R_5$ and $R_6$ represent aryl groups, the aryl group may be substituted. Substituents may include those as enumerated for the aryl groups of $R_1$ to $R_4$.

Of the diffusive DIR compounds as mentioned above, those having eliminable groups represented by the formula (2A), (2B), (2E) or (5) are particularly preferred.

As the yellow image forming coupler residue represented by A in the formula (1), there may be included the coupler residues of pivaloylacetanilide type, benzoylacetanilide type, malondiester type, malondiamide type, dibenzoylmethane type, benzothiazolylacetamide type, malonestermonoamide type, benzothiazolyl acetate type, benzoxazolylacetamide type, benzoxazolyl acetate type, malondiester type, benzimidazolylacetamide type or benzimidazolyl acetate type; the coupler residues derived from heterocyclic substituted acetamide or heterocyclic substituted acetate included in U.S. Pat. No. 3,841,880; coupler residues derived from acylacetamides disclosed in U.S. Pat. No. 3,770,446, U.K. Pat. No. 1,459,171, West German OLS No. 2,503,099, Japanese Provisional Patent Publication No. 139738/1975 or Research Disclosure No. 15737; or the heterocyclic coupler residue as disclosed in U.S. Pat. No. 4,046,574.

The magenta color image forming coupler residue represented by A may preferably be a coupler residue having a 5-oxo-2-pyrazoline nucleus, pyrazolone-[1,5-a]-benzimidazole nucleus or a cyanoacetophenone type coupler residue.

The cyano color image forming coupler residue represented by A may preferably be a coupler residue having a phenol nucleus, an α-naphthol nucleus, indazolone type or pyrazolotriazole type coupler residue.

Further, even if substantially no dye is formed after release of the developing inhibitor by coupling of the coupler with the oxidized product of a developing agent, the effect as the DIR coupler is the same. This type of coupler residue represented by A may include the coupler residues disclosed in U.S. Pat. No. 4,052,213, No. 4,088,491, No. 3,632,345, No. 3,958,993 or No. 3,961,959.

In the following, sepcific examples of the diffusive DIR compounds of the present invention are enumerated below, but these are not limitative of the present invention.

[Exemplary compounds]

D-1

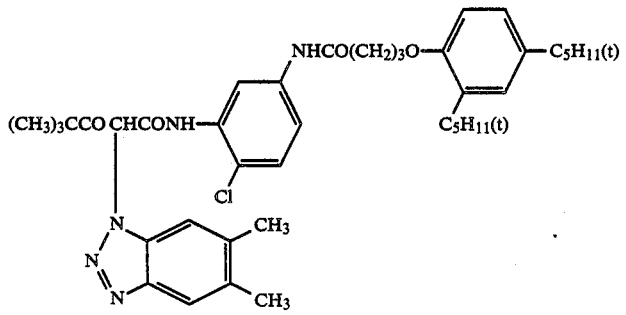

-continued
D-2
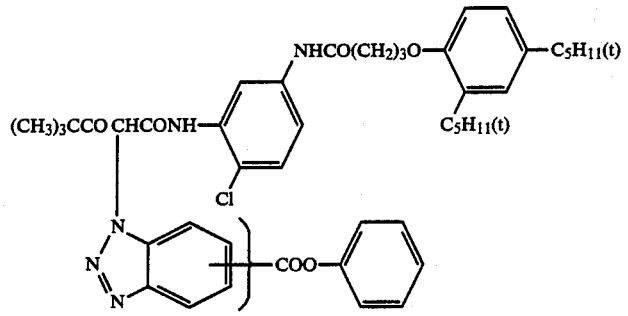
D-3
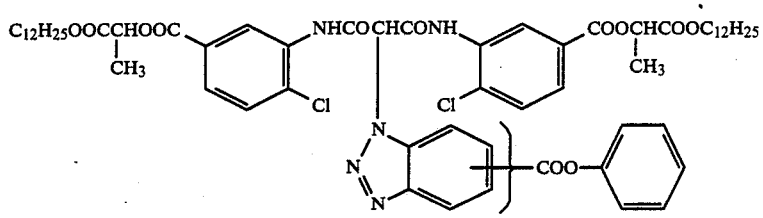
D-4
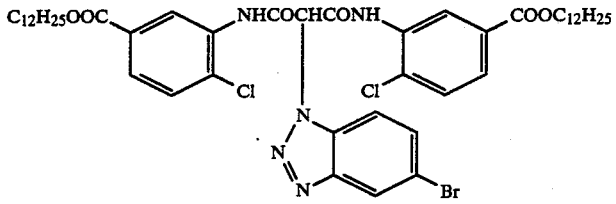
D-5
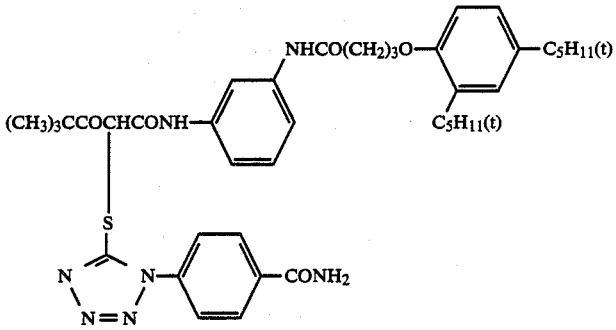
D-6
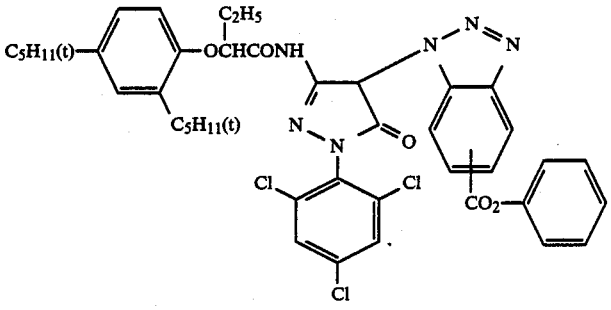

-continued
D-7
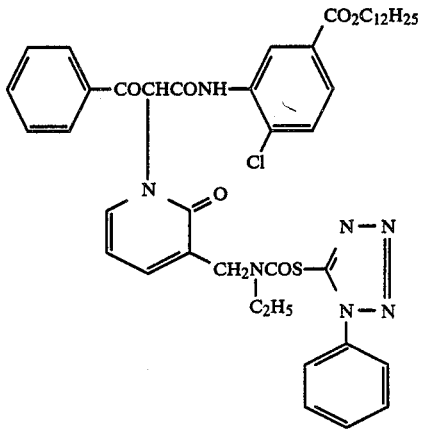
D-8
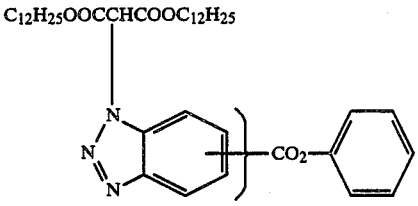
D-9
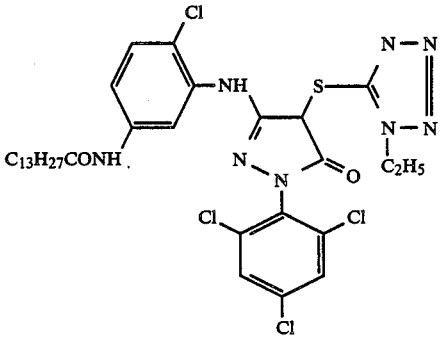
D-10
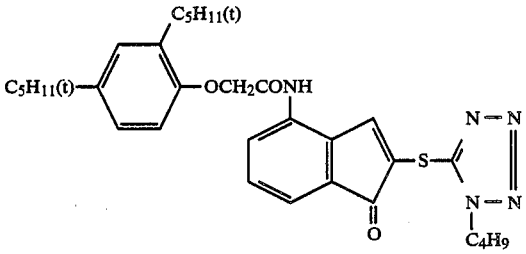
D-11
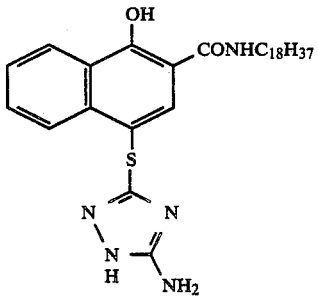
D-12
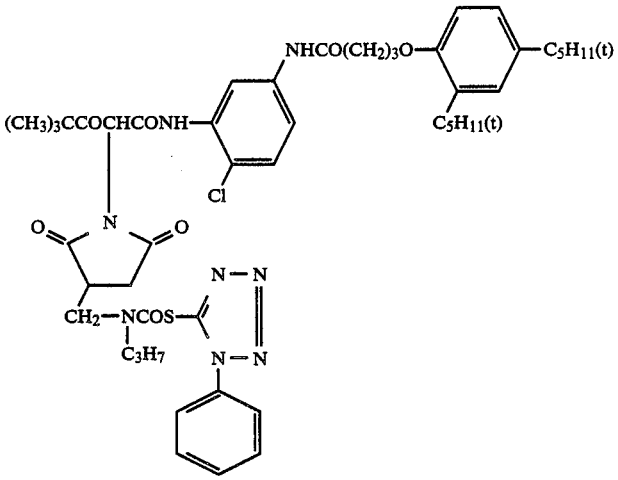

-continued
D-13
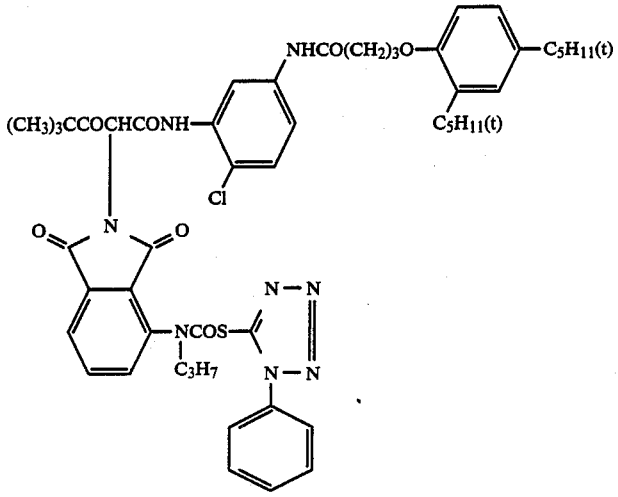
D-14
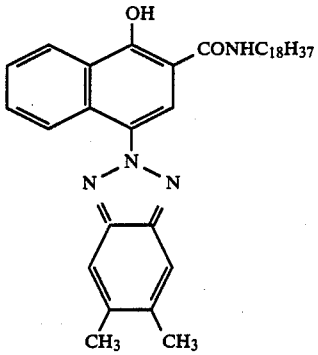
D-15
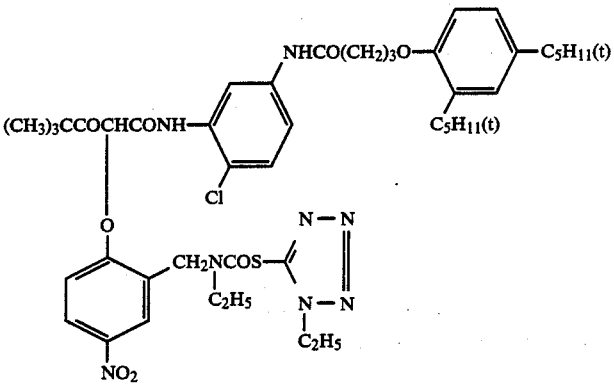
D-16
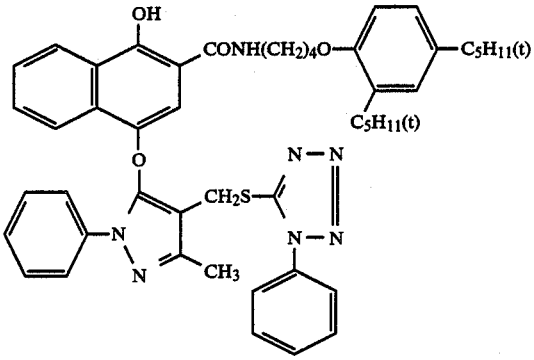
D-17
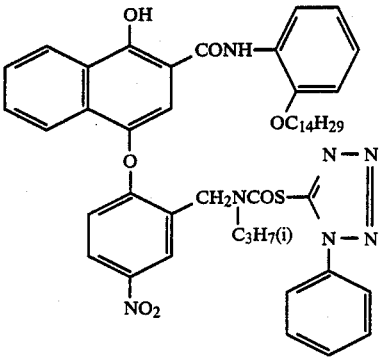
D-18
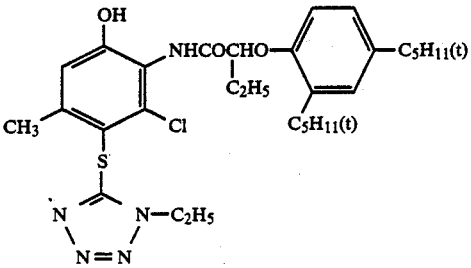
D-19
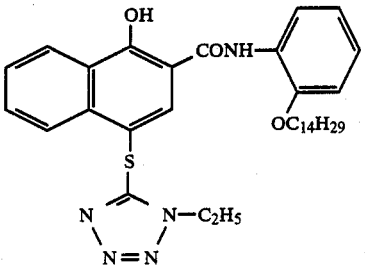

-continued
D-20
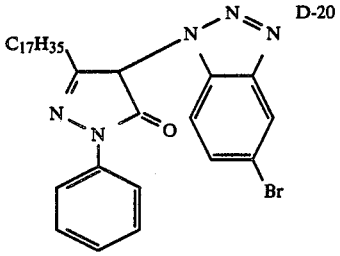
D-21
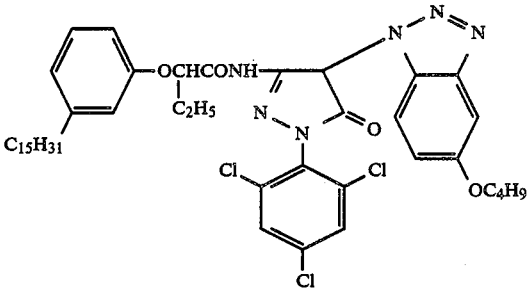
D-22
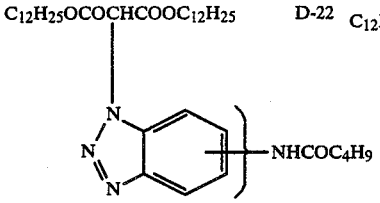
D-23
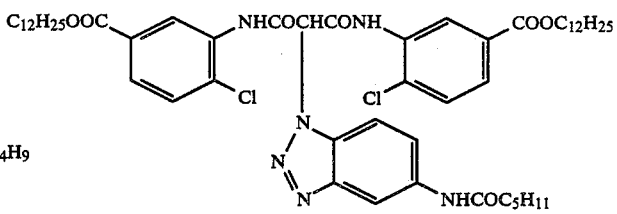
D-24
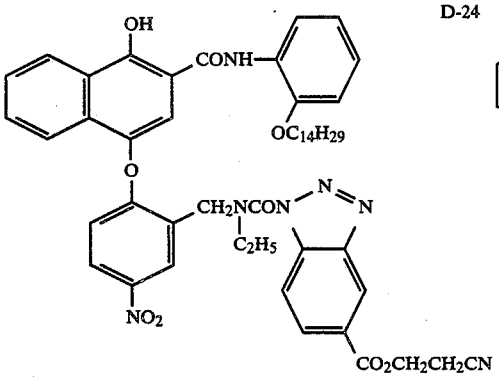
D-25
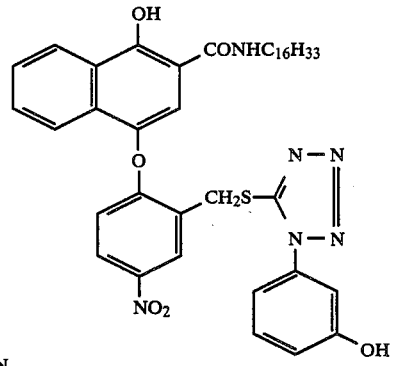
D-26
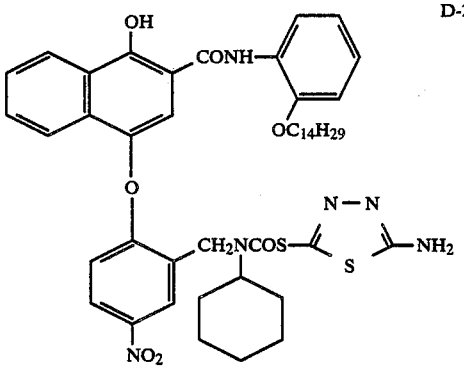
D-27
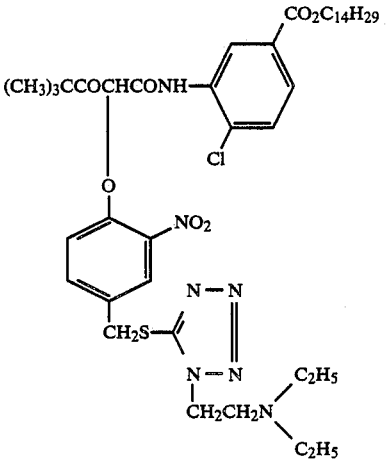

-continued
D-28
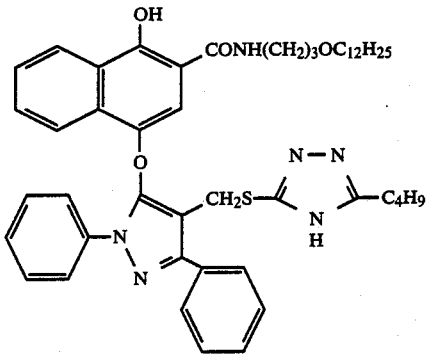
D-29
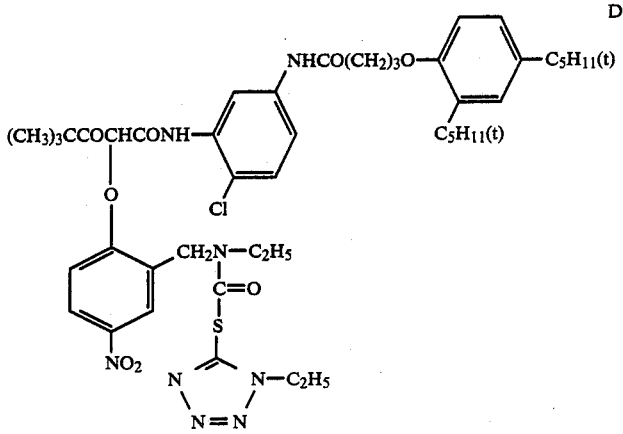
D-30
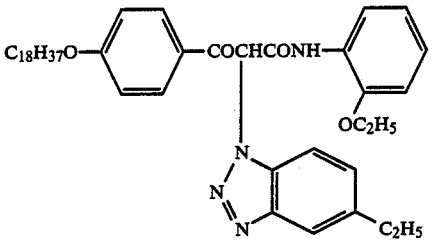
D-31
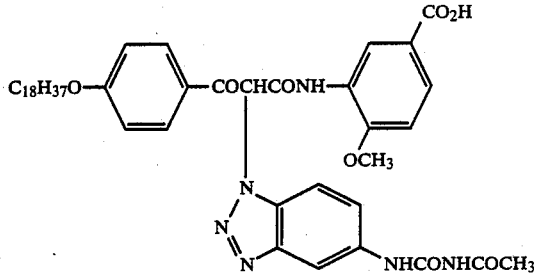
D-32
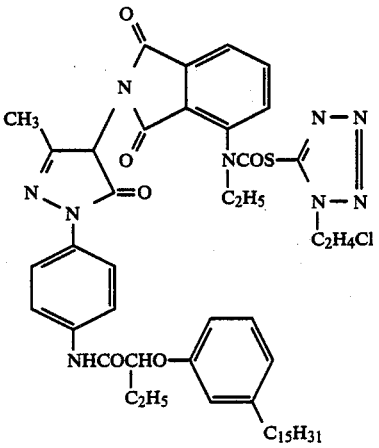
D-33
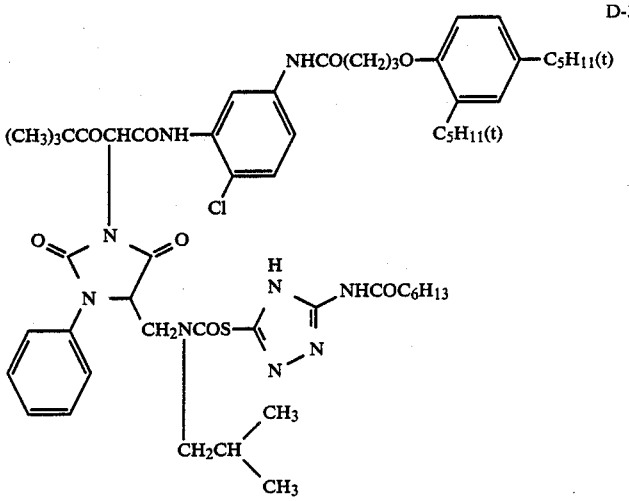
D-34
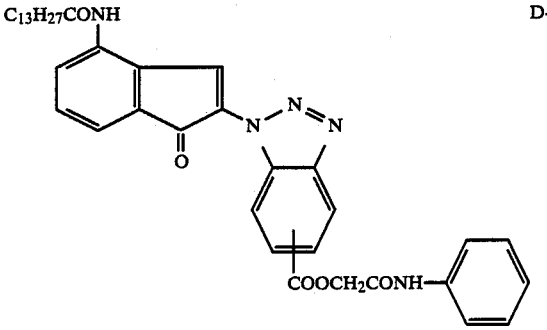
D-35
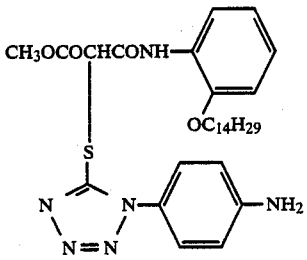

-continued
D-36
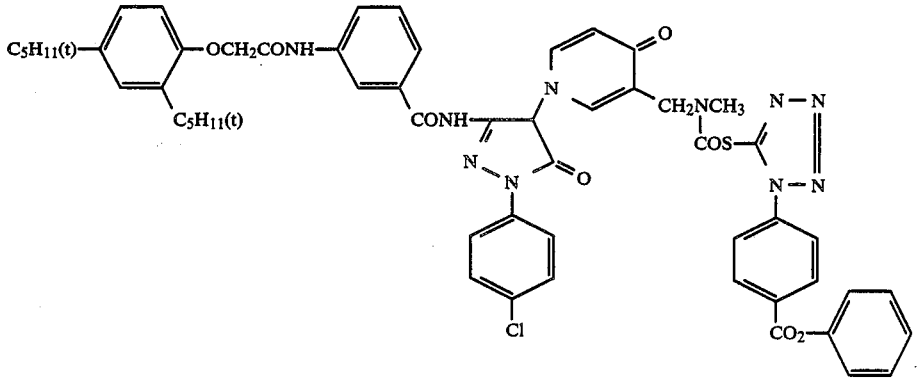
D-37
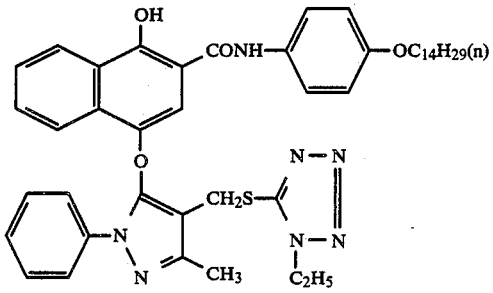
D-38
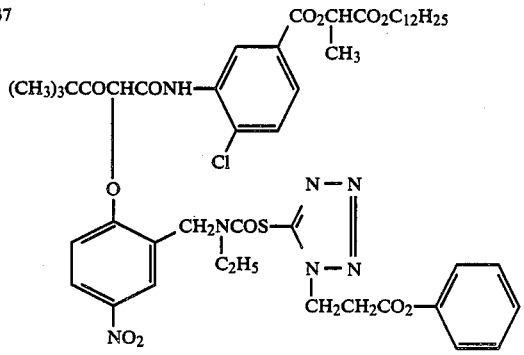
D-39
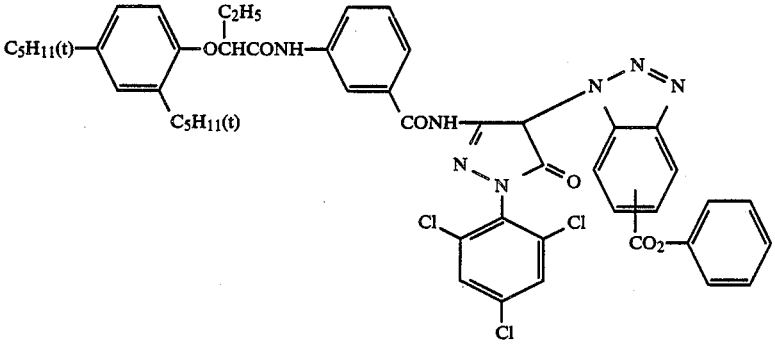
D-40
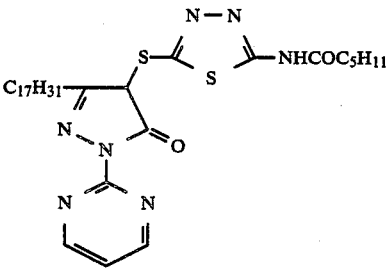
D-41
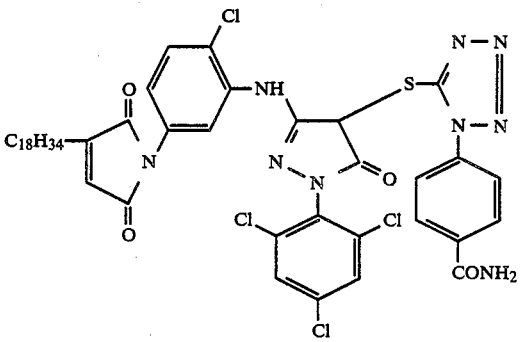

-continued
D-42
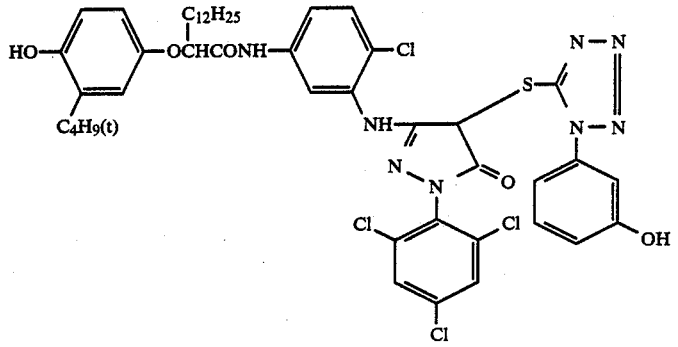
D-43
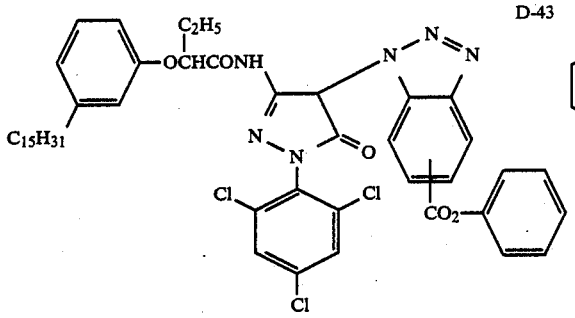
D-44
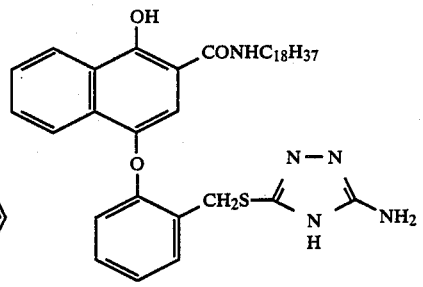
D-45
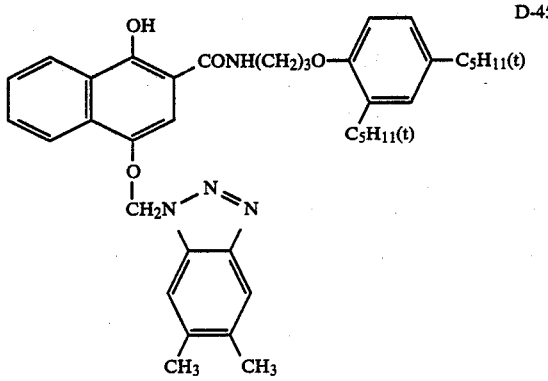
D-46
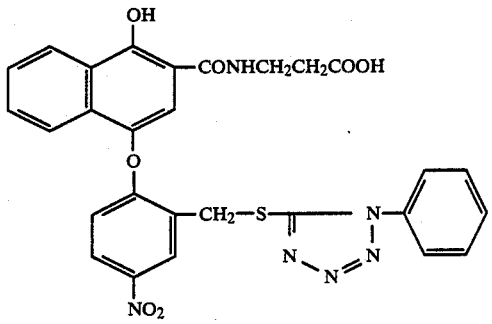
D-47
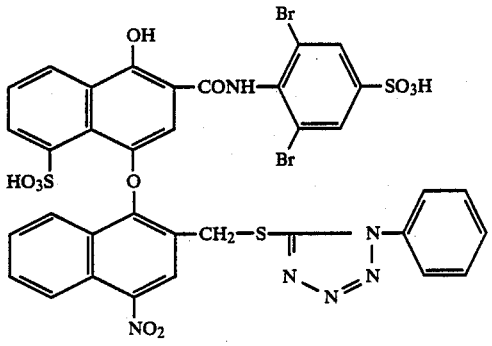
D-48
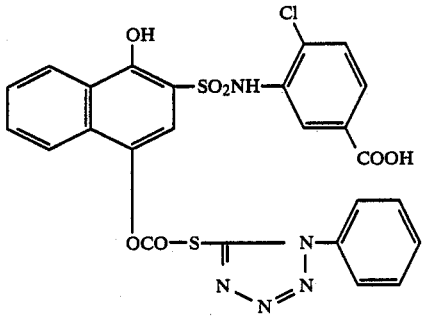

-continued
D-49
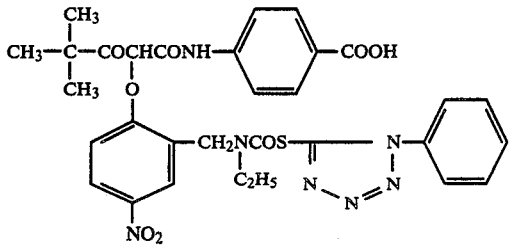
D-50
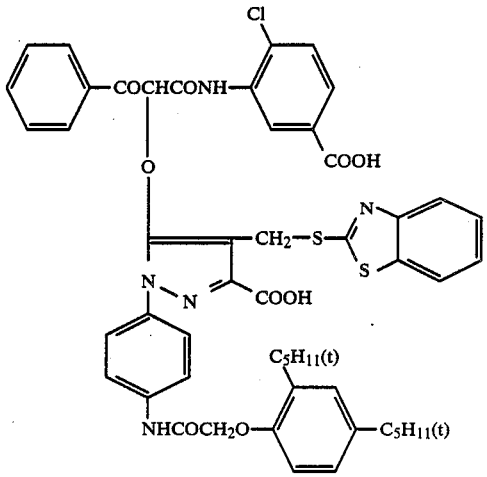
D-51
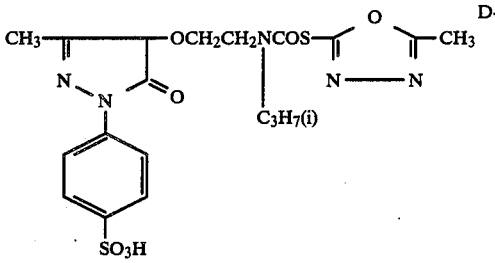
D-52
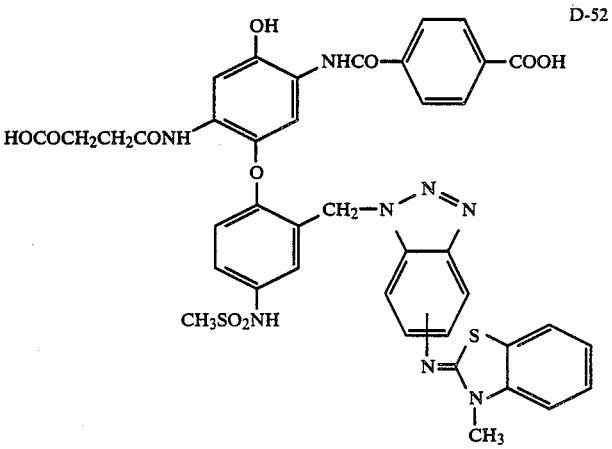
D-53
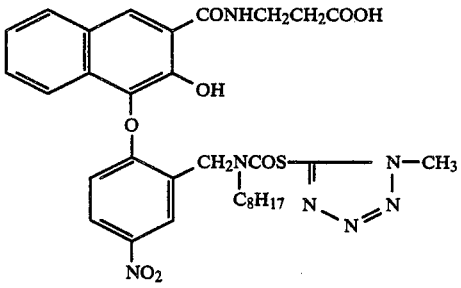
D-54
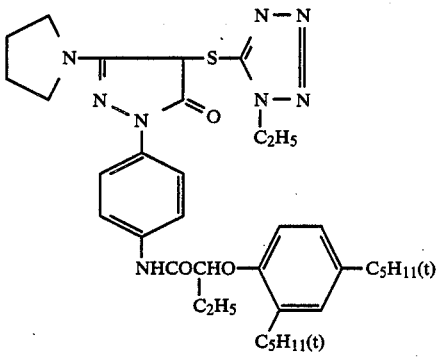
D-55
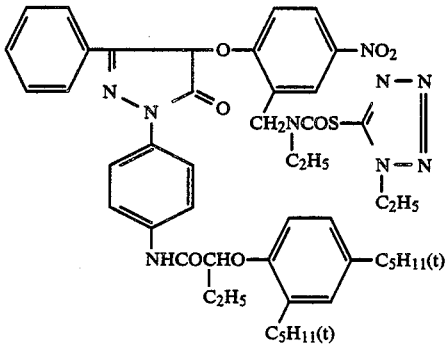
D-56
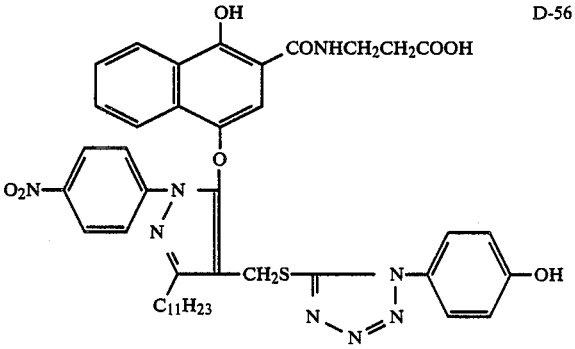

-continued

D-57

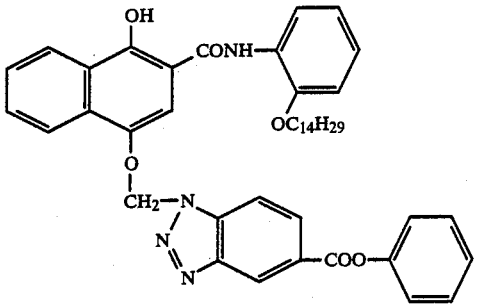

D-58

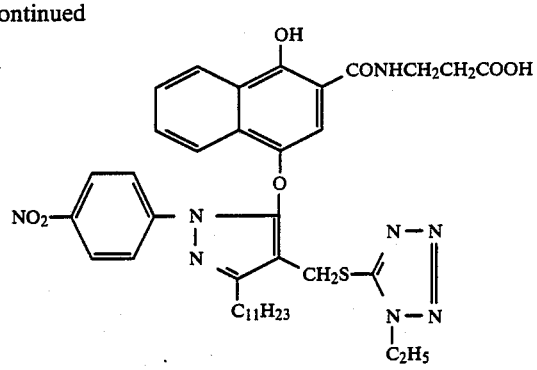

D-59

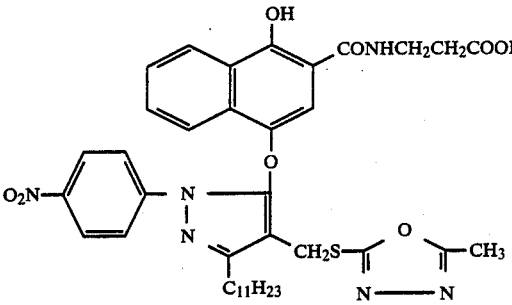

D-60

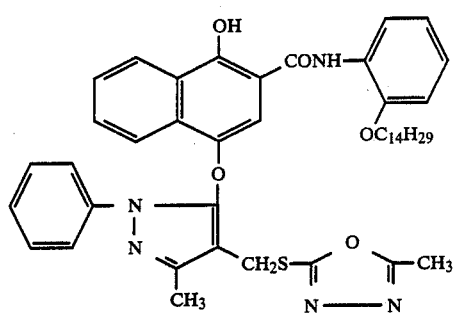

D-61

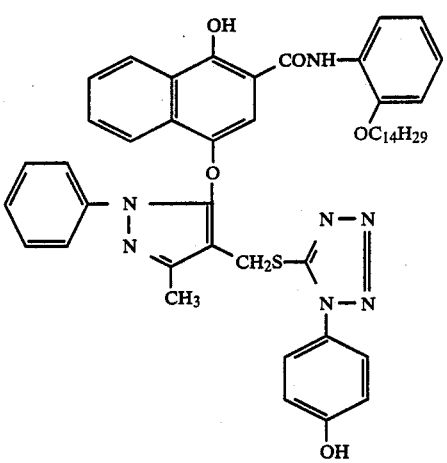

These compounds can be synthesized easily according to the methods as disclosed in U.S. Pat. No. 4,234,678, No. 3,227,554, No. 3,617,291, No. 3,958,993, No. 4,149,886 and No. 3,933,500; Japanese Provisional Patent Publication No. 56837/1982; Japanese Patent Publication No. 13239/1976; U.K. Pat. No. 2,072,363 and No. 2,070,266; and Research Disclosure No. 21228, December, 1981.

To describe in more detail about the light-sensitive material of the present invention, a conventional colored magenta coupler can be used in combination in the green-sensitive emulsion layer of the present invention. As the colored magenta coupler, those disclosed in U.S. Pat. Nos. 2,801,171 and 3,519,429 and Japanese Patent Publication No. 27930/1973 can be used.

Particularly preferrable colored magenta couplers are shown below.

(CM-1)

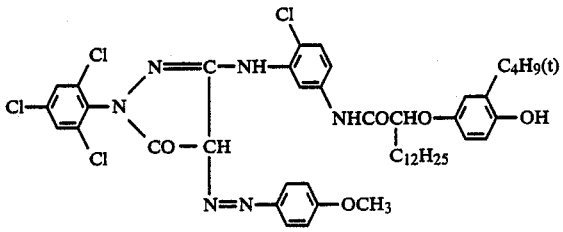

(CM-2)

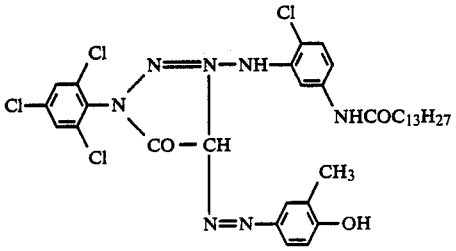

-continued (CM-3)

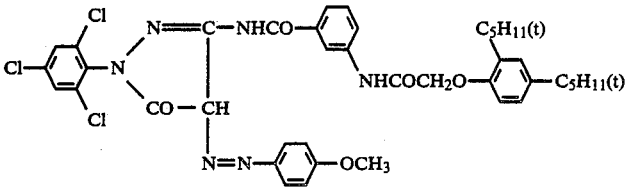

(CM-4)

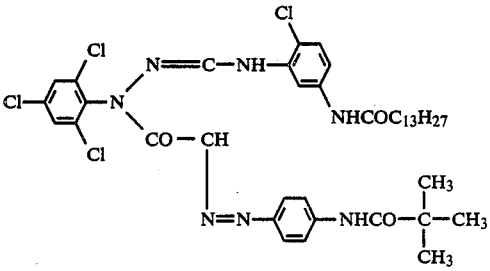

(CM-5)

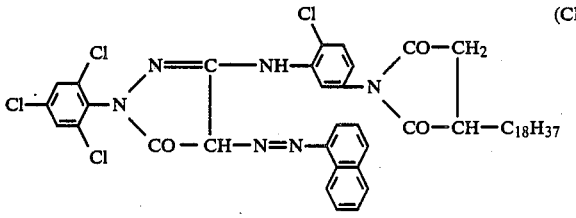

On the other hand, a conventional colored cyan coupler can be used in the red-sensitive emulsion layer of the present invention. As the colored cyan coupler, those disclosed in Japanese Patent Publication No. 32461/1980, U.K. Pat. No. 1,084,480, etc. can be used.

Particularly preferable colored cyan couplers are shown below.

(CC-1)

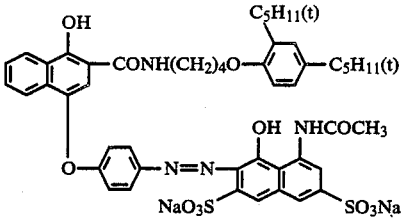

(CC-2)

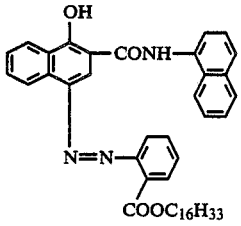

-continued (CC-3)

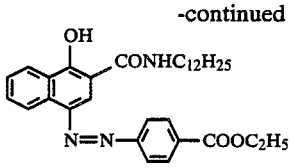

In the light-sensitive emulsion layer constituting the light-sensitive material of the present invention, the respective corresponding color forming couplers can be contained.

In the blue-sensitive layer of the present invention, it is generally preferable to contain a coupler for forming a yellow dye and, as said yellow color forming coupler, known open-chain ketomethylene type couplers can be employed. Among them, benzoylacetanilide type and pivaloylacetanilide type compounds can be advantageously used.

Examples of the yellow color forming couplers may include those disclosed in Japanese Provisional Patent Publications No. 26133/1972, No. 29432/1973, No. 87650/1975, No. 17348/1976 and No. 102636/1976; Japanese Patent Publication No. 19956/1970; U.S. Pat. No. 2,875,057, No. 3,408,194 and No. 3,519,429; Japanese Patent Publications No. 33410/1976, No. 10783/1976 and No. 19031/1971, etc.

Particularly preferable couplers are shown below.

(Y-1)

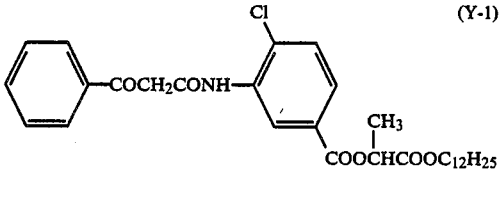

(Y-2)

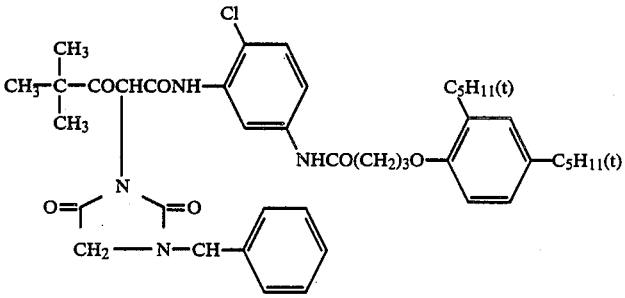

-continued
(Y-3)
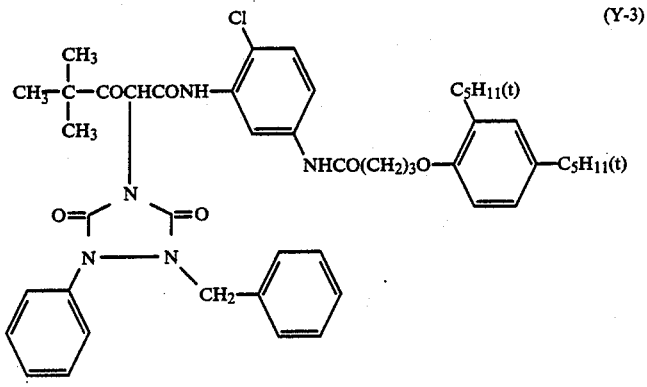
(Y-4)
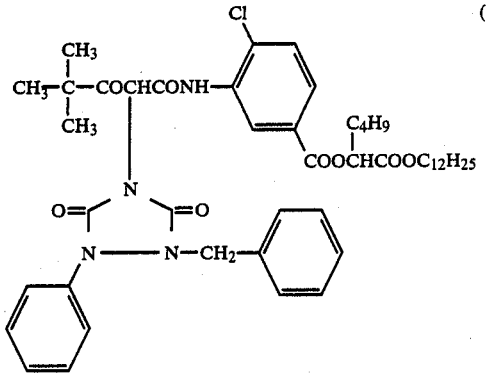
(Y-5)
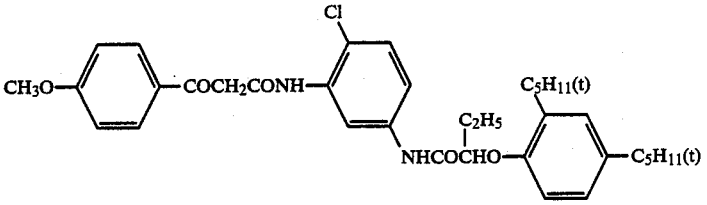
(Y-6)
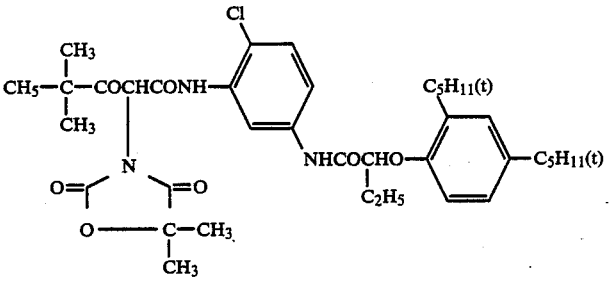
(Y-7)
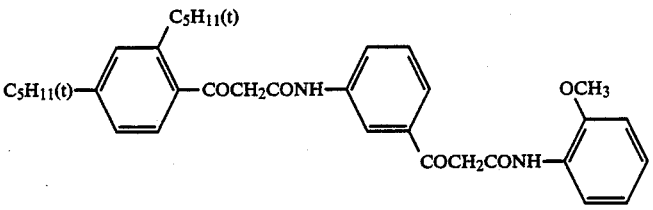
(Y-8)
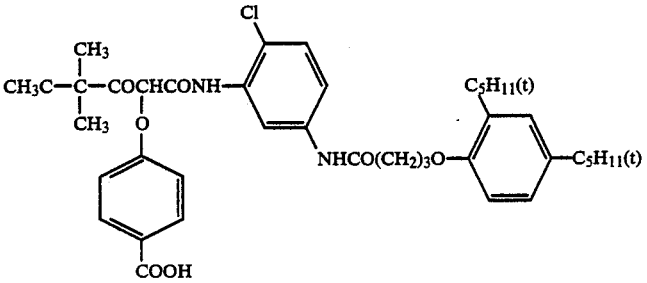

-continued (Y-9)

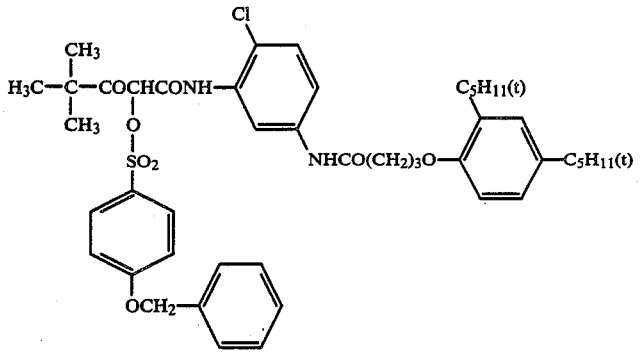

(Y-10)

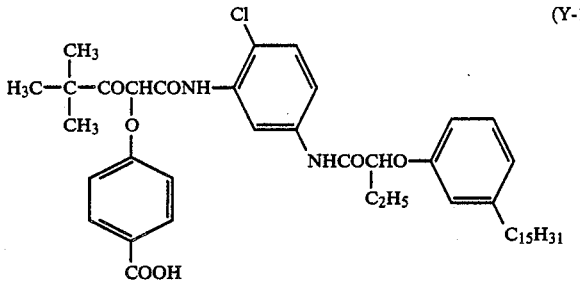

(Y-11)

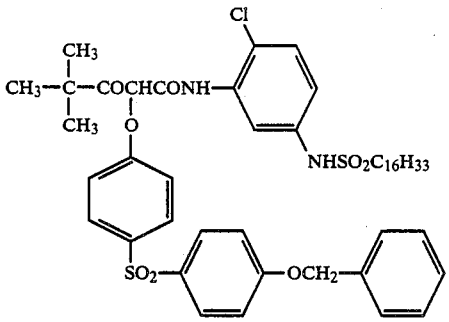

(Y-12)

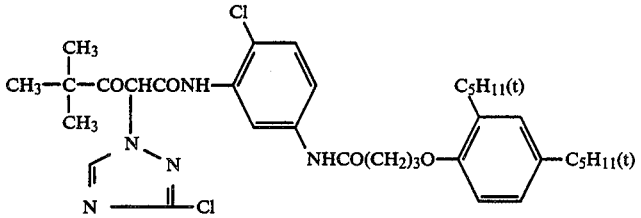

(Y-13)

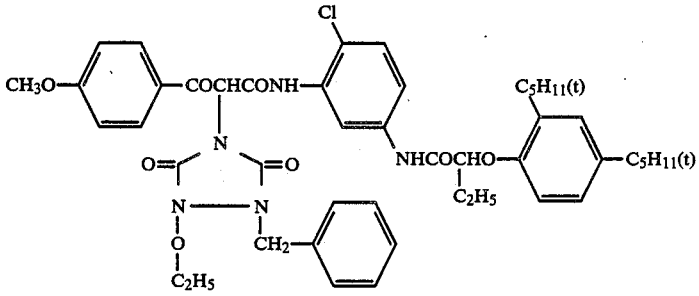

(Y-14)

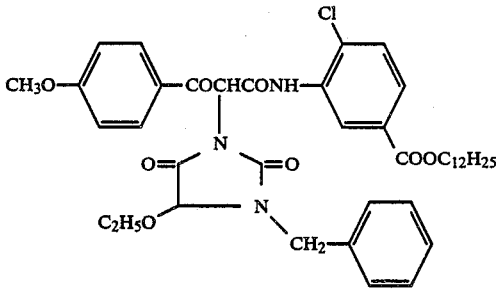

(Y-15)

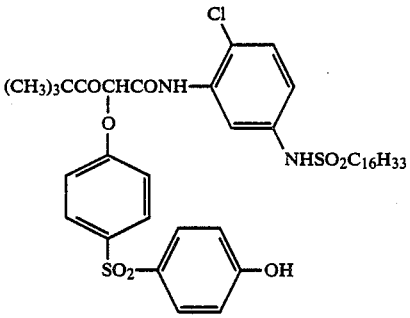

As the magenta color forming couplers to be used in the light-sensitive material of the present invention, it is possible to use pyrazolone type compounds, indazolone type compounds, cyanoacetyl compounds, pyrazolotriazole compounds, particularly advantageously pyrazolone type compounds.

Examples of usable magenta color forming coupler include those disclosed in Japanese Provisional Publication No. 111631/1974, Japanese Patent Publication No.

27930/1973, Japanese Provisional Patent Publication No. 29236/1981, U.S. Pat. No. 2,600,788, No. 3,062,653, No. 3,408,194 and No. 3,519,429, Japanese Provisional Patent Publication No. 94752/1982 and Research Disclosure No. 12443.
Particularly preferable couplers are shown below.
(M - 1)
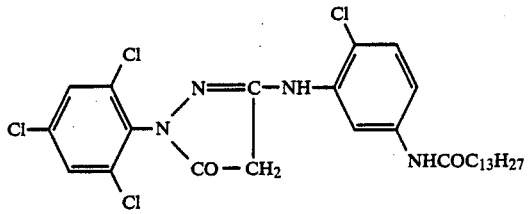
(M - 2)
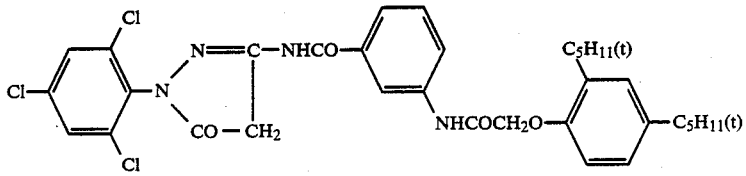
(M - 3)
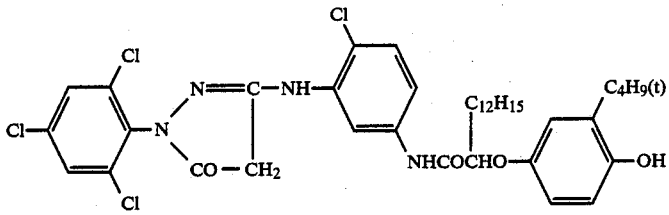
(M - 4)
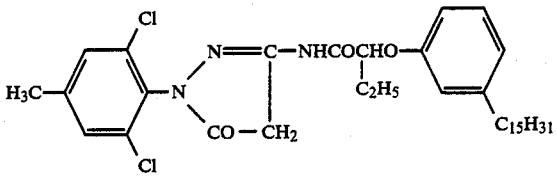
(M - 5)
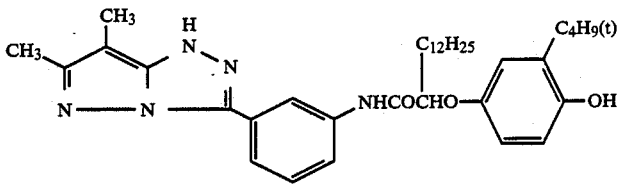
(M - 6)
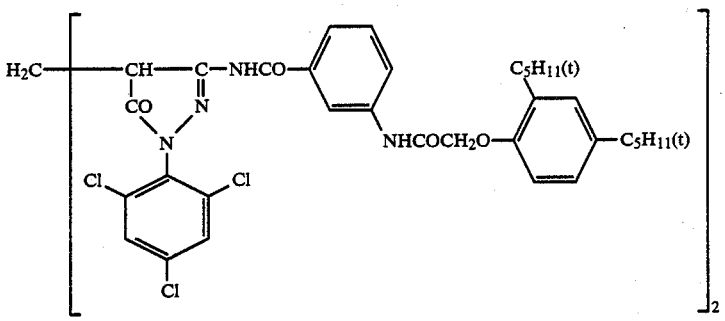
(M - 7)
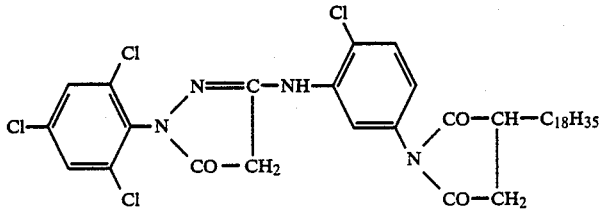

-continued
(M - 8)
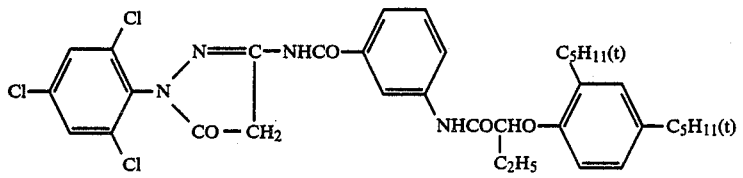
(M - 9)
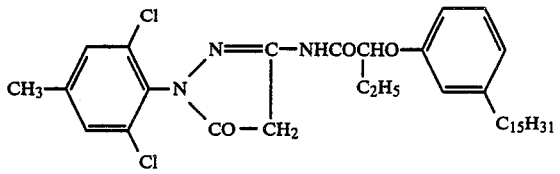
(M - 10)
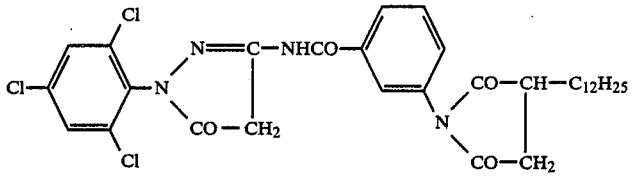
(M - 11)
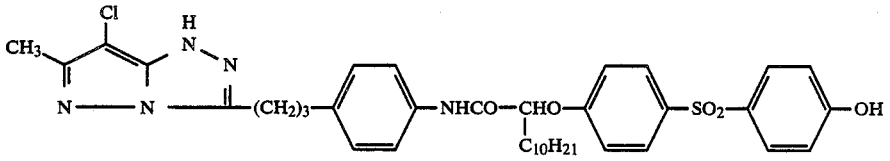
(M - 12)
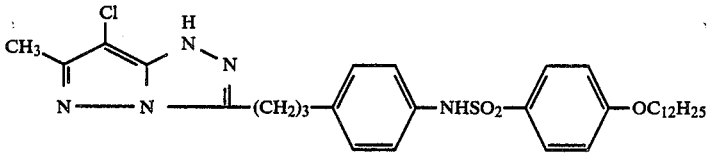
(M - 13)
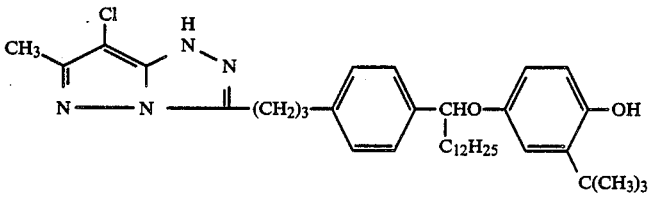
(M - 14)
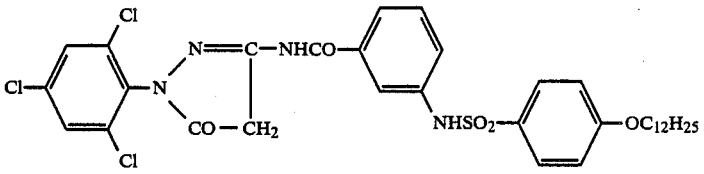
(M - 15)
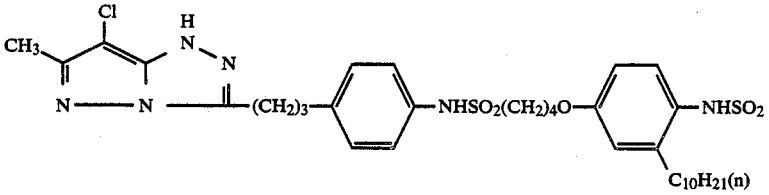
The cyan color forming couplers to be used in the light-sensitive material of the present invention may be phenol type compounds, naphthol type compounds, etc.
Its specific examples may include those disclosed in U.S. Pat. No. 2,423,730, No. 2,474,293 and No. 2,895,826 and Japanese Provisional Patent Publication No. 117422/1975.
Particularly preferable couplers are shown below.

(C - 1)
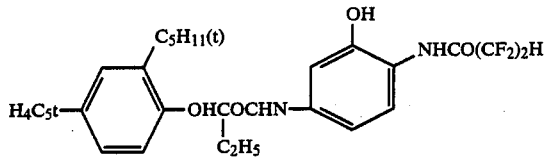
(C - 2)
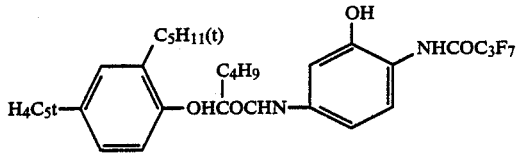
(C - 3)
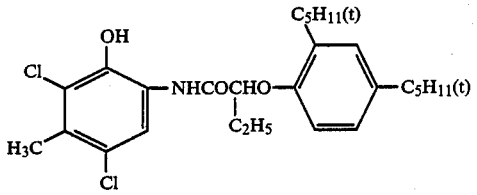
(C - 4)
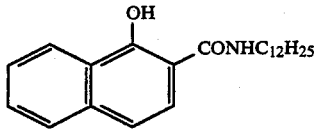
(C - 5)
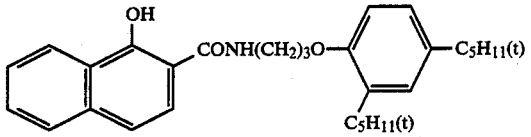
(C - 6)
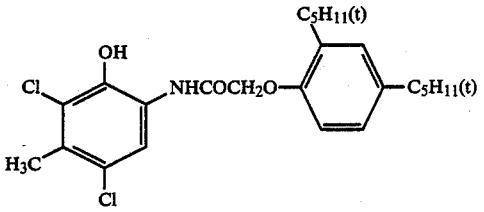
(C - 7)
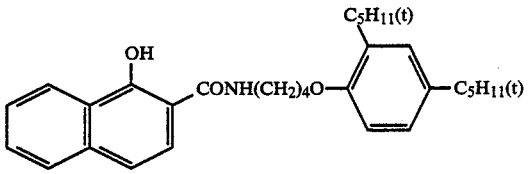
(C - 8)
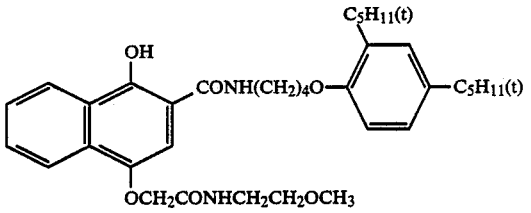
(C - 9)
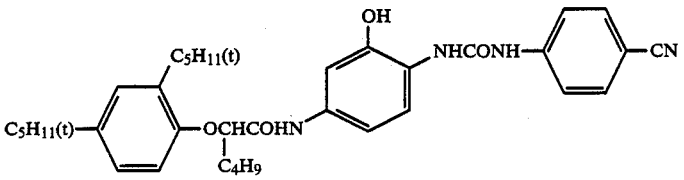

-continued
(C - 10)
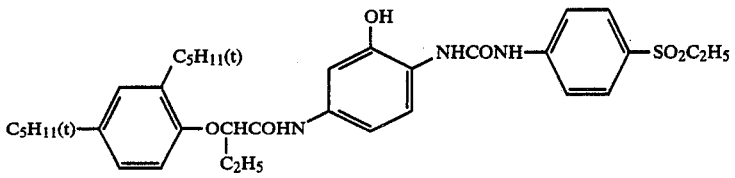
(C - 11)
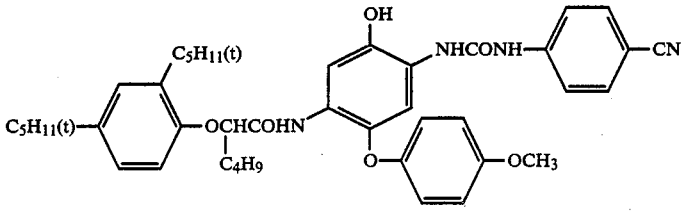
(C - 12)
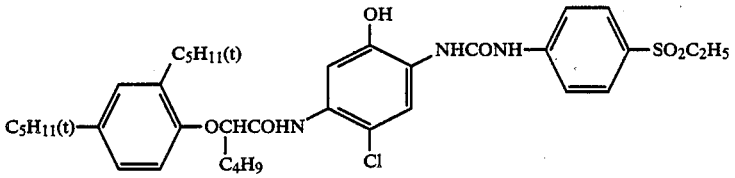
(C - 13)
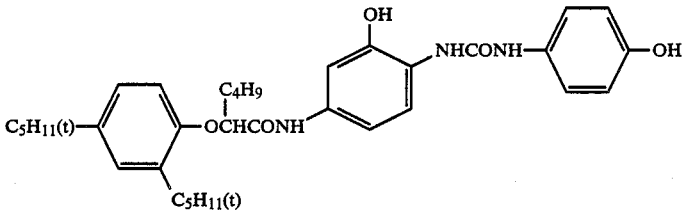
(C - 14)
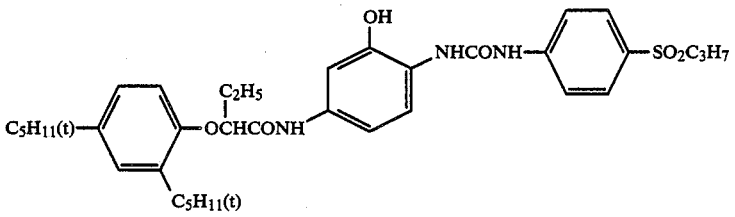
(C - 15)
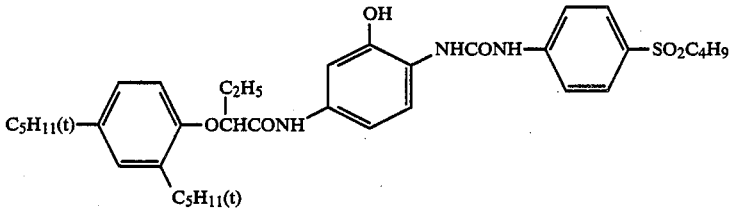
(C - 16)
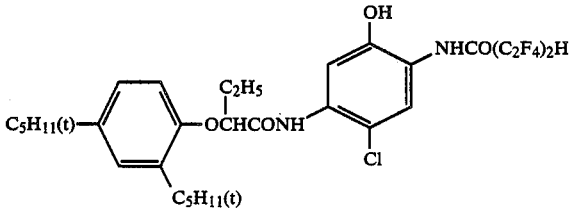

-continued (C - 17)

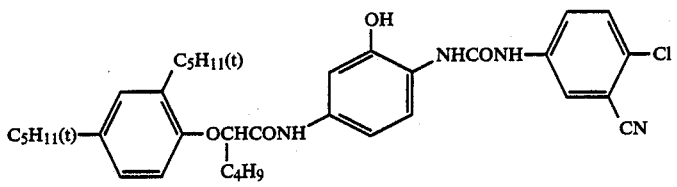

(C - 18)

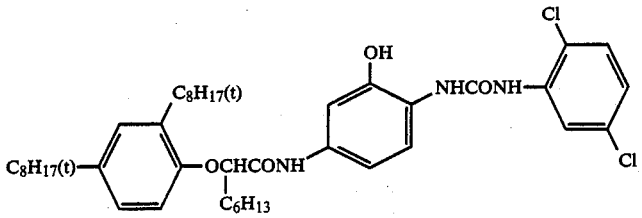

(C - 19)

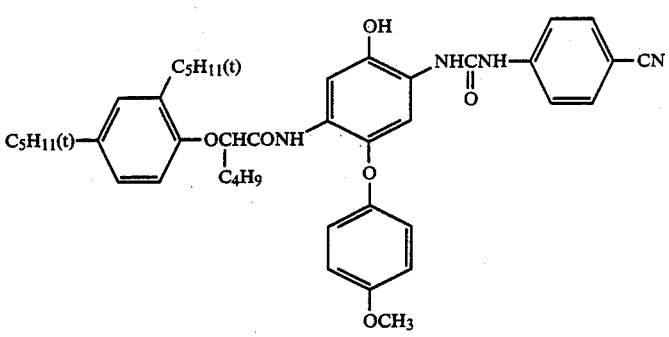

In the silver halide emulsion layer and other photographic constituent layers, it is also possible to use in combination with other couplers than the diffusive DIR compound of the present invention such as non-diffusive DIR compounds, non-diffusive couplers capable of forming an appropriately penetrable diffusive dye through the reaction with the oxidized product of a developing agent, polymer couplers and others. Non-diffusive DIR compounds, non-diffusive couplers capable of forming an appropriately penetrable diffusive dye through the reaction with the oxidized product of a developing agent are described in Japanese Patent Application No. 193611/1984 by the present Applicant, while the polymer couplers in Japanese Patent Application No. 172151/1984 by the present Applicant, respectively. The total amount of the couplers used in respective layers may be determined appropriately, since the maximum concentration differs depending on the individual color forming characteristics of the respective couplers, but it is preferred to use an amount of about 0.01 to 0.30 mole per mole of silver halide.

For incorporating these diffusive DIR compounds and couplers in the silver halide emulsion according to the present invention, when said diffusive DIR compounds and couplers are alkali-soluble, they may be added as alkaline solutions; when they are oil-soluble, they can preferably be dissolved in a high boiling point solvent, optionally together with a low boiling point solvent, according to the methods as disclosed in U.S. Pat. No. 2,322,027, No. 2,801,170, No. 2,801,171, No. 2,272,191 and No. 2,304,940, to be dispersed in fine particles before addition into the silver halide emulsion. If desired, a hydroquinone derivative, a UV-ray absorber, a color fading preventive, etc. may also be used in combination. Also, two or more kinds of couplers may be used as a mixture. Further, to describe in detail about the preferable method for addition of diffusive DIR compounds and couplers, one or two or more kinds of said diffusive DIR compounds and couplers, optionally together with other couplers, a hydroquinone derivative, a color fading preventive, a UV-ray absorber, etc., are dissolved in a high boiling point solvent such as organic acid amides, carbamates, esters, ketones, urea derivatives, ethers, hydrocarbons, specifically di-n-butylphthalate, tricresyl phosphate, triphenyl phosphate, di-iso-octylazelate, di-n-butylsebacate, tri-n-hexylphosphate, N,N-diethylcaprylamidobutyl, N,N-diethyllaurylamide, n-pentadecylphenylether, dioctylphthalate, n-nonylphenol, 3-pentadecylphenylethyl ether, 2,5-di-sec-amylphenylbutyl ether, monophenyl-di-o-chlorophenyl phosphate or fluoroparaffins, and/or a low boiling point solvent such as methyl acetate, ethyl acetate, propyl acetate, butyl acetate, butyl propionate, cyclohexanol, diethyleneglycol monoacetate, nitromethane, carbon tetrachloride, chloroform, cyclohexane, tetrahydrofuran, methyl alcohol, acetonitrile, dimethylformamide, dioxane, methyl ethyl ketone, etc., the resultant solution is mixed with an aqueous solution containing an anionic surfactant such as alkylbenzenesulfonic acid and alkylnaphthalenesulfonic acid and/or a nonionic surfactant such as sorbitane sesquioleic acid ester and sorbitane monolauryl acid ester and/or an aqueous solution containing a hydrophilic binder such as gelatin, etc., emulsified by means of a high speed rotary mixer, a colloid mill or a sonication dispersing device, etc. and added into the silver halide emulsion.

Otherwise, the above coupler may also be dispersed by use of the latex dispersing method. The latex dispersing method and its effect are described in Japanese Provisional Patent Publications No. 74538/1974, No. 59943/1976 and No. 32552/1979 and Research Disclosure No. 14850, August, 1976, pp. 77–79.

Suitable latices are homopolymers, copolymers or terpolymrs of monomers such as styrene, acrylate, n-butyl acrylate, n-butyl methacrylate, 2-acetoacetoxyethyl methacrylate, 2-(methacryloyloxy)ethyltrimethylammonium methosulfate, sodium 3-(methacryloyloxy)propane-1-sulfonate, N-isopropylacrylamide, N-[2-(2-methyl-4-oxopentyl)]acrylamide, 2-acrylamide-2-methylpropanesulfonic acid, etc.

In the light-sensitive silver halide color photographic material of the present invention, various kinds of other additives for photography can be contained. For example, there can be employed color staining preventives as disclosed in Japanese Provisional Patent Publication No. 2128/1971 and U.S. Pat. No. 2,728,659, antifoggants, stabilizers, UV-ray absorbers, color staining preventives, color image fading preventives, antistatic agents, film hardeners, surfactants, plastifiers, wetting agents, etc. as disclosed in Research Disclosure No. 17643. In the light-sensitive silver halide color photographic material of the present invention, the hydrophilic colloid to be used for preparation of the emulsion may include any of gelatin, gelatin derivatives, graft polymer of gelatin with other polymers, proteins such as albumin, casein, etc., cellulose derivatives such as hydroxyethyl cellulose, carboxymethyl cellulose, etc., starch derivatives, synthetic hydrophilic homopolymers or copolymers such as polyvinyl alcohol, polyvinyl imidazole, polyacrylamide, etc.

As the support for light-sensitive silver halide color photographic material of the present invention, there may be employed, for example, baryta paper, polyethylene-coated paper, polypropylene synthetic paper, transparent supports provided with reflective layer of employing a reflective material in combination, such as glass plate, cellulose acetate, cellulose nitrate or polyester films such as polyethyleneterephthalate, polyamide film, polycarbonate film, polystyrene film, etc. Further, conventional transparent supports may also be used, and these supports may be suitably selected depending on the purpose of use of the light-sensitive material.

For coating of the emulsion layers and other constituent layers to be used in the present invention, it is possible to use various coating methods such as dipping coating, air doctor coating, curtain coating, hopper coating, etc. Also, simultaneous coating of two or more layers can also be used as disclosed in U.S. Pat. Nos. 2,761,791 and 2,941,898.

Since the light-sensitive silver halide color photographic material constituted as mentioned above of the present invention is also preserved for several months to several years until it is applied for actual use, when it is sealed up and packed while maintaining the relative humidity of 55% or less as in the conventionally known method for the light-sensitive photographic material, it exhibits the effects of the present invention sufficiently when used.

The method for processing the light-sensitive photographic material according to the present invention is not particularly limited, but all processing methods are applicable. For example, there may be employed typically any of the method in which, after color development, bleach-fixing processing is performed, followed optionally by water washing and/or stabilizing processing; the method in which, after color development, bleaching and fixing are performed separately, followed optionally by water washing and/or stabilizing processing; the method in which pre-film-hardening, neutralization, color developing, stopping fixing, water washing, bleaching, fixing, water washing, post-film-hardening and water washing are performed in this order; the method in which color developing, water washing, supplemental color developing, stopping, bleaching, fixing, water washing and stabilizing are performed in this order; the developing method in which the developed silver formed by color developing is subjected to halogenation bleach, followed by color developing again to increase the amount of the dye formed; etc.

The color developing solution to be used in processing of the silver halide emulsion layer according to the present invention is an aqueous alkaline solution containing a color developing agent having a pH preferably of 8 or higher, more preferably of 9 to 12. The aromatic primary amine developing agent as the color developing agent is a compound having a primary amino group on the aromatic ring with an ability to develop the exposed silver halide, and further a precursor capable of forming such a compound may be added if necessary.

Typical examples of the above color developing agent are p-phenylenediamine type compounds, and preferable examples include the following:

4-amino-N,N-diethylaniline, 3-methyl-4-amino-N,N-diethylaniline, 4-amino-N-ethyl-N-β-hydroxyethylaniline, 3-methyl-4-amino-N-β-hydroxyethylaniline, 3-methyl-4-amino-N-ethyl-N-β-methoxyethylaniline, 3-methyl-4-amino-N-ethyl-N-β-methanesulfonamidoethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-dimethylaniline, N-ethyl-N-β-[β-(β-methoxyethoxy)ethoxy]-ethyl-3-methyl-4-aminoaniline, N-ethyl-N-β-(β-methoxyethoxy)ethyl-3-methyl-4-aminoaniline, or salts thereof such as sulfates, hydrochlorides, sulfites, p-toluenesulfonates, etc.

Further, those disclosed in, for example, Japanese Provisional Patent Publications No. 64932/1973, No. 131526/1975 and No. 95849/1976, and Bent et al, Journal of the American Chemical Society, vol. 73, pp. 3100–3125 (1951) may also be included as typical examples.

The amount of these aromatic primary amino compounds used may be determined depending on the activity of the developing solution set, and it is preferable to increase the amount used in order to increase the activity. The amount used may be within the range of from 0.0002 mole/liter to 0.7 mole/liter. Also, depending on the purpose, two or more compounds may be suitably selected and used. For example, any desired combination can freely be used such as the combinations of 3-methyl-4-amino-N,N-diethylaniline with 3-methyl-4-amino-N-ethyl-N-β-methanesulfonamidoethylaniline, 3-methyl-4-amino-N-ethyl-N-β-methanesulfonamidoethylaniline with 3-methyl-4-amino-N-ethyl-N-β-hydroxyethylaniline, etc.

The color developing solution to be used in the present invention can further incorporate various components conventionally added, for example, alkali agents such as sodium hydroxide, sodium carbonate, etc., alkali metal sulfites, alkali metal hydrogen sulfites, alkali metal thiocyanates, alkali metal halides, benzyl alcohol, water softeners, thickeners and development promoters, as desired.

Other additives than those as mentioned above which can be added to the above developing solution may include, for example, compounds for rapid processing solutions such as bromides (e.g. potassium bromide, ammonium bromide), alkali iodides, nitrobenzimidazole, mercaptobenzimidazole, 5-methyl-benzotriazole, 1-phenyl-5-mercaptotetrazole, etc., strain preventives, sludge preventives, preservatives, overlaying effect promoting agents, chelating agents, etc.

As the bleaching agent to be used in the bleaching solution or the bleach-fixing solution in the bleaching step, there have been generally known aminopolycarboxylic acids or organic acids such as oxalic acid, citric acid, etc. having metal ions such as of iron, cobalt, copper, etc. coordinated. Typical examples of the above aminopolycarboxylic acids may include the following:

Ethylenediaminetetraacetic acid,
Diethylenetriaminepentaacetic acid,
Propylenediaminetetraacetic acid,
Nitrilotriacetic acid,
Iminodiacetic acid,
Ethyletherdiaminetetraacetic acid,
Ethylenediaminetetrapropionic acid,
Disodium ethylenediaminetetraacetate,
Pentasodium diethylenetriaminepentaacetate, and
Sodium nitrilotriacetate.

The bleaching solution may also contain various additives together with the above bleaching agent. Also, when employing a bleach-fixing solution in the bleaching step, a solution with a composition containing a silver halide fixing agent in addition to the above bleaching agent is applied. Further, the bleach-fixing solution may also contain a silver halide compound such as potassium bromide. And, similarly as in the case of the above bleaching solution, other various additives such as pH buffering agents, defoaming agents, surfactants, preservatives, chelating agents, stabilizers, organic solvents, etc. may also be added and contained.

The silver halide fixing agent may include, for example, sodium thiosulfate, ammonium thiosulfate, potassium thiocyanate, sodium thiocyanate, or compounds capable of forming water-soluble silver salts through the reaction with silver halides conventionally used in fixing processing, such as thiourea, thioether, etc.

The processing temperature in the various processing steps such as color developing, bleach-fixing (or bleaching and fixing), further water washing, stabilizing, drying, etc. optionally conducted may preferably be 30° C. or higher from the standpoint of rapid processing.

The light-sensitive silver halide color photographic material may also be subjected to the stabilizing processing substituting for water washing as disclosed in Japanese Provisional Patent Publications No. 14834/1983, No. 105145/1983, No. 134634/1983 and No. 18631/1983 and Japanese Patent Applications No. 2709/1983 and No. 89288/1984.

According to the light-sensitive silver halide color photographic material of the present invention, the I.I.E in both directions can be made greater between the different color-sensitive layers, whereby color reproduction can be improved, particularly saturation (chroma) reproduction can be improved, simultaneously with improvement of sharpness of image.

The present invention is described in more detail by referring to the following Examples, but the embodiments of the present invention are not limited thereto.

In all the Examples shown below, the amounts added in the light-sensitive silver halide color photographic material are indicated in amounts per 1 $m^2$, and the silver halide and colloidal silver calculated on silver.

EXAMPLE 1

Onto a cellulose triacetate support, the following respective layers are successively coated to prepare a multi-layer color film sample.

Layer 1 . . . Halation preventive layer (HC layer):

A halation preventive layer comprising 0.18 g of black colloidal silver and 1.5 g of gelatin.

Layer 2 . . . Subbing layer (1G layer):

A subbing layer comprising 2.0 g of gelatin.

Layer 3 . . . Low sensitivity layer of red-sensitive silver halide emulsion layer (RL layer):

A low sensitivity layer of a red-sensitive silver halide emulsion layer containing 1.4 g of an emulsion having an average grain size (r) of 0.48 μm and comprising AgBrI containing 6 mole % of AgI (emulsion I) color sensitized to red-sensitive with the sensitizing dye I ($4.0\times10^{-5}$ mole per mole of silver) and the sensitizing dye II ($0.7\times10^{-5}$ mole per mole of silver), 0.08 mole/mole Ag of a cyan coupler of the exemplary compound (C-7), 0.006 mole/mole Ag of a colored cyan coupler of the exemplary compound (CC-1), a DIR compound indicated in Table 4, 0.5 g of tricresyl phosphate (called TCP) and 1.80 g of gelatin.

Layer 4 . . . Intermediate layer (2G layer):

An intermediate layer comprising 0.14 g of 2,5-di-t-butylhydroquinone and 0.07 g of dibutylphthalate (called DBP).

Layer 5 . . . Low sensitivity layer of green-sensitive silver halide emulsion layer (GL layer):

A low sensitivity layer of a green-sensitive silver halide emulsion layer containing 1.1 g of the emulsion I color sensitized to green-sensitive with the sensitizing dye III ($1.6\times10^{-5}$ mole per mole of silver) and the sensitizing dye IV ($0.8\times10^{-5}$ mole per mole of silver), 0.07 mole/mole Ag of a magenta coupler of the exemplary compound (M-2), 0.015 mole/mole Ag of a colored magenta coupler of the exemplary compound (CM-5), a DIR compound indicated in Table 4, 0.64 g of TCP and 1.4 g of gelatin.

Layer 6 . . . Protective layer (3G layer):

A protective layer containing 0.8 g of gelatin.

The used sensitizing dyes I to IV are as follows:

Sensitizing dye I: Anhydro-5,5'-dichloro-9-ethyl-3,3'-di-(3-sulfopropyl)thiacarbocyanine hydroxide Sensitizing dye II: Anhydro-9-ethyl-3,3'-di-(3-sulfopropyl)-4,5,4',5'-dibenzothiacarbocyanine hydroxide Sensitizing dye III: Anhydro-5,5'-diphenyl-9-ethyl-3,3'-di-(3-sulfopropyl)oxacarbocyanine hydroxide Sensitizing dye IV: Anhydro-9-ethyl-3,3'-di-(3-sulfopropyl)-5,6,5',6'-dibenzoxacarbocyanine hydroxide In the respective layers, in addition to those as mentioned above, there were incorporated gelatin hardeners and surfactants. Samples No. 1 to No. 11 containing the DIR compounds indicated in Table 4 and shown below (Ex-1) added into the RL layer of Layer 3 and the GL layer of Layer 5 were prepared.

Ex - 1

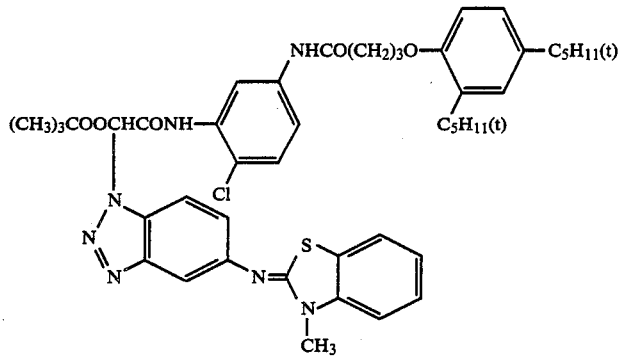

Each sample was given green light, red light, green light+red light through a wedge, and processed according to the following processing steps to obtain a dye image.

| Processing steps (38° C.): | |
|---|---|
| Color developing | 2 min. 40 sec. |
| Bleaching | 6 min. 30 sec. |
| Water washing | 3 min. 15 sec. |
| Fixing | 6 min. 30 sec. |
| Water washing | 3 min. 15 sec. |
| Stabilizing | 1 min. 30 sec. |
| Drying | |

The processing solutions used in the respective processing steps had the following compositions.

| | |
|---|---|
| [Color developing solution] | |
| 4-Amino-3-methyl-N—ethyl-N—(β-hydroxyethyl)aniline.sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| (made up to one liter with addition of water). | |
| [Bleaching solution] | |
| Ferric ammonium ethylenediamine-tetraacetate | 100.0 g |
| Diammonium ethylenediamine-tetraacetate | 10.0 g |
| Ammonium bromide | 150.0 g |
| Glacial acetic acid | 10.0 ml |
| (made up to one liter with addition of water, and adjusted to pH = 6.0 with aqueous ammonia). | |
| [Fixing solution] | |
| Ammonium thiosulfate | 175.0 g |
| Anhydrous sodium sulfite | 8.5 g |
| Sodium metasulfite | 2.3 g |
| (made up to one liter with addition of water, and adjusted to pH = 6.0 with acetic acid). | |
| [Stabilizing solution] | |
| Formalin (37% aqueous solution) | 1.5 ml |
| Konidax (trade name, produced by Konishiroku Photo Industry K.K.) | 7.5 ml |
| (made up to one liter with addition of water). | |

The characteristic values obtained are shown in Table 4. The amount of the DIR compound added into each color-sensitive layer is controlled so that sensitivity reduction and density lowering in its own layer may be subatantially equal to each other.

TABLE 4

| Sample No. | Green-sensitive silver halide emulsion layer: Compound | Added amount (× $10^{-2}$ mole/mole Ag) | Red-sensitive silver halide emulsion layer: Compound | Added amount (× $10^{-2}$ mole/mole Ag) | I.I.E. (γA/γN) G | R | Remark |
|---|---|---|---|---|---|---|---|
| 1 | D-3 | 0.25 | D-3 | 0.15 | 1.25 | 1.27 | Comparative |
| 2 | D-58 | 0.5 | D-58 | 0.6 | 1.21 | 1.25 | Comparative |
| 3 | D-3 | 0.25 | D-58 | 0.6 | 1.45 | 1.51 | This invention |
| 4 | D-58 | 0.5 | D-3 | 0.15 | 1.25 | 1.18 | Comparative |
| 5 | D-56 | 0.4 | D-59 | 0.5 | 1.53 | 1.57 | This invention |
| 6 | D-59 | 0.3 | D-56 | 0.25 | 1.19 | 1.17 | Comparative |
| 7 | D-3 | 0.25 | D-17 | 0.25 | 1.48 | 1.45 | This invention |
| 8 | D-3 | 0.25 | Ex-1 | 0.2 | 1.37 | 1.40 | Comparative |
| 9 | Ex-1 | 0.2 | D-58 | 0.6 | 1.33 | 1.41 | Comparative |
| 10 | D-56 | 0.4 | D-58 | 0.6 | 1.47 | 1.55 | This invention |
| 11 | D-17 | 0.25 | D-59 | 0.5 | 1.42 | 1.48 | This invention |

When the γ* of the sample exposed to green light measured by green light is expressed as γAG, while γ* when exposed to green light+red light is as γNG, γAG/γNG represents the greatness of I.I.E. received by the green-sensitive silver halide emulsion layer. Similarly, when the γ* of the sample exposed to red light measured by red light is expressed as γAR, while γ* when exposed to green light+red light is as γNR, γAR/γNR represents the greatness of I.I.E. received by the red-sensitive silver halide emulsion. As the I.I.E. received is greater, $\gamma A/\gamma N$ becomes greater.

*: when the density at the point of dose which is ten-fold ($\Delta \log E = 1.0$) of the dose at the density point with fog of +0.3 is D, $\gamma = \{D - (fog + 0.3)\}/1.0$.

As is apparent from Table 4, each DIR compound is added so that the self-layer developing inhibiting power in each layer alone may be substantially equal, and the amount added clearly shows that the combination of the present invention is smaller in the self-layer developing inhibiting power (added in larger amount), with the I.I.E. mutually between the color-sensitive layer also becoming greater. Thus, the effectiveness of the present invention is exhibited.

EXAMPLE 2

Onto a cellulose triacetate support, the following respective layers were successively coated to prepare a multi-layer color film sample.

Layer 1 . . . Halation preventive layer (HC layer):

A halation preventive layer comprising 0.24 g of black colloidal silver and 1.7 g of gelatin.

Layer 2 . . . Interception layer (IL layer):

A interception layer comprising 0.14 g of 2,5-di-t-octylhydroquinone, 0.7 g of DBP and 0.8 g of gelatin.

Layer 3 . . . Low sensitivity layer of red-sensitive silver halide emulsion layer (RL layer):

A low sensitivity layer of a red-sensitive silver halide emulsion layer containing 1.4 g of the red-sensitive silver halide emulsion used in Layer 3 of Example 1, 0.65 g of a cyan coupler of the exemplary compound (C-7), 0.05 g of a colored cyan coupler of the exemplary compound (CC-1), a DIR compound indicated in Table 5, 0.53 g of TCP and 1.80 g of gelatin.

Layer 4 . . . High sensitivity layer of red-sensitive silver halide emulsion layer (RH layer):

A high sensitivity layer of red-sensitive silver halide emulsion layer containing 0.9 g of an emulsion having an average grain size (r) of 0.8 μm and comprising AgBrI containing 6 mole % of AgI (emulsion II) sensitized to red-sensitive with the sensitizing dye I ($2.0 \times 10^{-5}$ mole per mole of silver) and the sensitizing dye II ($0.6 \times 10^{-5}$ mole per mole of silver), 0.21 g of a cyan coupler of the exemplary compound (C-8), 0.21 g of TCP and 1.2 g of gelatin.

Layer 5 . . . Interception layer (IL layer):

The same as the IL layer of the above Layer 2.

Layer 6 . . . Low sensitivity layer of green-sensitive silver halide emulsion layer (GL layer):

A low sensitivity layer of a green-sensitive silver halide emulsion layer containing 1.1 g of the green-sensitive silver halide emulsion used in Layer 5 of Example 1, 0.52 g of a magenta coupler of the exemplary compound (M-2), 0.12 g of a colored magenta coupler of the exemplary compound (CM-5), a DIR compoud indicated in Table 5, 1.5 g of TCR and 1.4 g of gelatin.

Layer 7 . . . High sensitivity layer of green-sensitive silver halide emulsion layer (GH layer):

A high sensitivity layer of a green-sensitive silver halide emulsion layer containing 0.9 g of the emulsion II color sensitized to green-sensitive with the sensitizing dye III ($0.9 \times 10^{-5}$ mole per mole of silver) and the sensitizing dye IV ($0.6 \times 10^{-5}$ mole per mole of silver), 0.28 g of a magenta coupler of the exemplary compound (M-12), 0.05 g of a colored magenta coupled of the exemplary compound (CM-5), 0.33 g of TCP and 1.2 g of gelatin.

Layer 8 . . . Interception layer (IL layer):

The same as the IL layer of the above Layer 2.

Layer 9 . . . Low sensitivity layer of blue-sensitive silver halide emulsion layer:

A low sensitivity layer of a green-sensitive silver halide emulsion layer containing 0.5 g of the emulsion I color sensitized to blue-sensitive with the sensitizing dye V ($1.3 \times 10^{-5}$ mole per mole of silver), 1.0 g of a yellow coupler of the exemplary compound (Y-4), a DIR compoud indicated in Table 5, 0.14 g of TCP and 1.2 g of gelatin.

Layer 10 . . . High sensitivity layer of blue-sensitive silver halide emulsion layer (GH layer):

A high sensitivity layer of a blue-sensitive silver halide emulsion layer containing 0.5 g of the emulsion II color sensitized to blue-sensitive with the sensitizing dye V ($1.0 \times 10^{-5}$ mole per mole of silver), 0.75 g of a yellow coupler of the exemplary compound (Y-4), 0.08 g of TCP and 1.2 g of gelatin.

Layer 11 . . . Protective layer (PL layer):

A protective layer containing 1.3 g of gelatin.

The used sensitizing dyes I to IV are the same as those used in Example 1, respectively and the sensitizing dye V is as follows:

Sensitizing dye V: Anhydro-3,3'-di-(3-sulfopropyl)-4,5-benzo-5'-methoxythiacyanine The thus prepared Sample No. 21 was then modified as shown in the following Table 5 to prepare Samples No. 22 to No. 28.

In the respective layers, there were incorporated gelatin hardeners and surfactants.

Each of the above Samples No. 21 to No. 28 was given blue light, green light, red light and white light through a wedge, and processed in the same manner as Example 1 except for changing the developing time to 3 min. and 15 sec. to obtain a dye image. The results are shown in Table 5 similarly as Example 1.

TABLE 5

| Sample No. | DIR compound (amount added, × $10^{-2}$ mole/mole Ag) Blue-sensitive silver halide emulsion layer BH | BL | Green-sensitive silver halide emulsion layer GH | GL | Red-sensitive silver halide emulsion layer RH | RL | Photographic characteristics ($\gamma A/\gamma N$) B | G | R | MTF*G (%) | Remark |
|---|---|---|---|---|---|---|---|---|---|---|---|
| 21 | — | D-58 (0.4) | — | D-58 (0.5) | — | D-37 (0.5) | 1.18 | 1.21 | 1.23 | 85 | Comparative |
| 22 | — | D-58 (0.4) | — | D-58 (0.3) | — | D-61 (0.25) | 1.15 | 1.18 | 1.19 | 83 | Comparative |
| 23 | — | D-58 (0.4) | — | D-56 (0.4) | — | D-37 (0.5) | 1.32 | 1.45 | 1.50 | 90 | This invention |
| 24 | — | D-58 (0.4) | — | D-56 (0.4) | — | D-60 (0.45) | 1.30 | 1.47 | 1.55 | 94 | This invention |
| 25 | — | D-58 (0.4) | D-56 (0.05) | D-56 (0.4) | D-60 (0.05) | D-60 (0.45) | 1.33 | 1.51 | 1.58 | 96 | This invention |
| 26 | — | D-3 | — | D-3 | — | D-3 | 1.20 | 1.32 | 1.28 | 88 | Comparative |

TABLE 5-continued

| Sample No. | DIR compound (amount added, × $10^{-2}$ mole/mole Ag) Blue-sensitive silver halide emulsion layer BH | BL | Green-sensitive silver halide emulsion layer GH | GL | Red-sensitive silver halide emulsion layer RH | RL | Photographic characteristics (γA/γN) B | G | R | MTF*G (%) | Remark |
|---|---|---|---|---|---|---|---|---|---|---|---|
| | | (0.3) | | (0.25) | | (0.15) | | | | | |
| 27 | — | D-58 (0.4) | — | D-3 (0.25) | — | D-37 (0.5) | 1.22 | 1.39 | 1.42 | 93 | This invention |
| 28 | — | D-58 (0.4) | — | D-3 (0.25) | — | D-17 (0.25) | 1.21 | 1.39 | 1.38 | 94 | This invention |

MTF*G = MTF value of Green density at frequency 20 cycle/mm.

As is apparent from Table 5, the Samples No. 23 to No. 25, No. 27 and No. 28 of the present invention are very great in γA/γN in respective color-sensitive layers as compared with Control samples, thus enabling reproduction of high chroma color. Also, MTF with the green light which is most sensitive to human eyes in high, whereby an image of high sharpness can be reproduced.

Separately from the above exposure, a landscape was actually photographed with the use of Samples No. 21 to No. 28, and the images printed on color paper were compared with each other. As a result, the samples of the present invention gave sharper images than expected with very bright colors and good MTF values. This may be considered due to the synergetic effect of brightness of color and sharpness.

Also, in both Examples 1 and 2, each DIR compound is added in an amount so that the self-layer developing inhibiting power may be substantially equal in each layer alone and, from the value of the amount of the DIR compound, the combination of the present invention is clearly smaller in self-layer developing inhibiting power (useable in greater amount), resulting in greater I.I.E mutually between the color-sensitive layers.

What is claimed is:

1. A light-sensitive silver halide photographic material, having two or more light-sensitive silver halide emulsion layers different in color sensitivities on a support, at least two of said light-sensitive silver halide emulsion-layers different in color sensitivities containing a DIR compound capable of releasing a developing inhibitor or a developing inhibitor precursor through the reaction with the oxidized product of a developing inhibitor, the developing inhibitor or developing inhibitor precursor released from said DIR compound being diffusive, wherein, in said at least two light-sensitive silver halide emulsion layers different in color sensitivities, the developing inhibitor(s) and/or developing inhibitor precursor(s) released from said DIR compounds contained in said at least two light-sensitive silver halide emulsion layers are different from each other and also each DIR compound may have greater inhibiting power for the other light-sensitive silver halide emulsion layer rather than for the light-sensitive silver halide emulsion layer in which it is incorporated.

2. A light-sensitive silver halide color photographic material according to claim 1, wherein said diffusive DIR compound has a developing inhibitor or developing inhibitor precursor having a diffusiveness of not less than 0.34.

3. A light-sensitive silver halide color photographic material according to claim 2, wherein said light-sensitive silver halide color photographic material comprises a developing inhibitor A and a developing inhibitor B are used in a green-sensitive silver halide emulsion layer and a red-sensitive silver halide emulsion layer, respectively, and when A is greater than B with respect to the developing inhibiting power for the green-sensitive silver halide emulsion layer and A is not greater than B with respect to the developing inhibiting power for the red-sensitive silver halide emulsion layer, a DIR compound having the developing inhibitor B is added in the green-sensitive silver halide emulsion layer and a DIR compound having the developing inhibitor A is added in the red-sensitive silver halide emulsion layer.

4. A light-sensitive silver halide color photographic material according to claim 2, wherein said light-sensitive silver halide color photographic material comprises a developing inhibitor C and a developing inhibitor D are used in a blue-sensitive silver halide emulsion layer and a green-sensitive silver halide emulsion layer, respectively, and when C is greater than D with respect to the developing inhibiting power for the blue-sensitive silver halide emulsion layer and C is not greater than D with respect to the developing inhibiting power for the green-sensitive silver halide emulsion layer, a DIR compound having the developing inhibitor D is added in the blue-sensitive silver halide emulsion layer and a DIR compound having the developing inhibitor C is added in the green-sensitive silver halide emulsion layer.

5. A light-sensitive silver halide color photographic material according to claim 2, wherein said light-sensitive silver halide color photographic material comprises a developing inhibitor E and a developing inhibitor F are used in a blue-sensitive silver halide emulsion layer and a red-sensitive silver halide emulsion layer, respectively, and when E is greater than F with respect to the developing inhibiting power for the blue-sensitive silver halide emulsion layer and E is not greater than F with respect to the developing inhibiting power for the red-sensitive silver halide emulsion-layer, a DIR compound having the developing inhibitor F is added in the blue-sensitive silver halide emulsion layer and a DIR compound having the developing inhibitor E is added in the red-sensitive silver halide emulsion layer.

6. A light-sensitive silver halide color photographic material according to claim 2, wherein said photographic material comprises a green-sensitive silver halide emulsion layer containing a diffusive DIR compound having at least one of an inhibiting group of

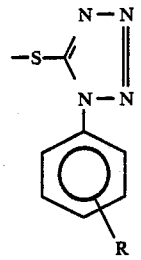

where R represents a hydrogen atom or a hydroxy group, or a benztriazole derivative and a red-sensitive silver halide emulsion layer containing a diffusive DIR compound having at least one of an inhibiting group of

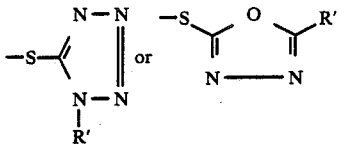

where R' represents a hydrocarbon group having carbon atoms of not more than 6.

7. A light-sensitive silver halide color photographic material according to claim 2, wherein said photographic material comprises a green-sensitive silver halide emulsion layer containing a diffusive DIR compound having at least one of an inhibiting group of

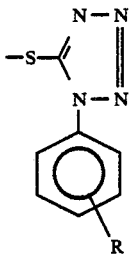

where R represents a hydrogen atom or a hydroxy group, or a benztriazole derivative and a blue-sensitive silver halide emulsion layer containing a diffusive DIR compound having at least one of an inhibiting group of

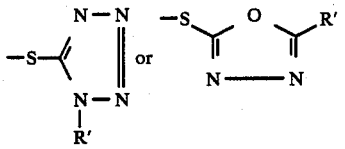

where R' represents a hydrocarbon group having carbon atoms of not more than 6.

8. A light-sensitive silver halide color photographic material according to claim 6, wherein said photographic material comprises a green-sensitive silver halide emulsion layer containing a diffusive DIR compound having an inhibiting group of

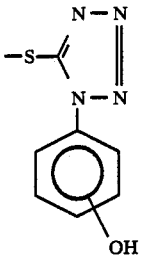

and a red-sensitive silver halide emulsion layer containing a diffusive DIR compound having an inhibiting group of

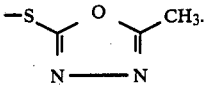

9. A light-sensitive silver halide color photographic material according to claim 1, wherein the strength relationship or developing inhibiting power of the developing inhibitor released from the DIR compound incorporated in a first color-sensitive silver halide emulsion layer to the first emulsion layer is smaller than that to a second color-sensitive silver halide emulsion layer, and strength relationship or developing inhibiting power of the developing inhibitor released from the DIR compound incorporated in the second color-sensitive silver halide emulsion layer to the second emulsion layer is smaller than that to the first emulsion layer.

10. A light-sensitive silver halide color photographic material having two or more light-sensitive silver halide emulsion layers of different color sensitivities on a support, and wherein said photographic material comprises a green-sensitive silver halide emulsion layer containing a diffusive DIR compound having at least one of an inhibiting group of

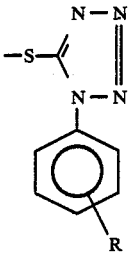

where R represents a hydrogen atom or a hydroxy group, or a benztriazole derivative; and a red-sensitive silver halide emulsion layer containing a diffusive DIR compound having at least one of an inhibiting group of

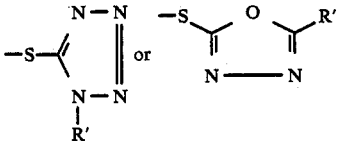

where R' represents a hydrocarbon group having not more than 6 carbon atoms.

* * * * *